US011318761B2

(12) United States Patent
Asamoto et al.

(10) Patent No.: US 11,318,761 B2
(45) Date of Patent: May 3, 2022

(54) LIQUID EJECTING SYSTEM AND CONTROL METHOD OF LIQUID EJECTING SYSTEM

(71) Applicant: SEIKO EPSON CORPORATION, Tokyo (JP)

(72) Inventors: Katsuya Asamoto, Matsumoto (JP); Takehito Washizawa, Shiojiri (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/942,125

(22) Filed: Jul. 29, 2020

(65) Prior Publication Data

US 2021/0031510 A1 Feb. 4, 2021

(30) Foreign Application Priority Data

Jul. 31, 2019 (JP) ..... JP2019-140797

(51) Int. Cl.
*B41J 2/045* (2006.01)
*B41J 11/00* (2006.01)

(52) U.S. Cl.
CPC ..... *B41J 11/002* (2013.01); *B41J 2/04566* (2013.01); *B41J 2/04586* (2013.01)

(58) Field of Classification Search
CPC ..... B41J 2/04566; B41J 11/002
See application file for complete search history.

(56) References Cited

U.S. PATENT DOCUMENTS

2002/0030846 A1* 3/2002 Moriyama ..... H04N 1/603 358/1.15
2002/0196457 A1 12/2002 Nunokawa
2006/0038870 A1* 2/2006 Nonaka ..... B41J 11/0005 347/104
2008/0068632 A1* 3/2008 Fukasawa ..... B41J 3/60 358/1.12
2013/0027456 A1* 1/2013 Nitta ..... B41J 2/04563 347/14
2013/0038656 A1* 2/2013 Mizutani ..... B41J 11/0095 347/16
2020/0079122 A1* 3/2020 Pohlt ..... B41J 11/0005

FOREIGN PATENT DOCUMENTS

JP 2003-001876 1/2003
JP 2015-158634 9/2015

* cited by examiner

*Primary Examiner* — Matthew Luu
*Assistant Examiner* — Kendrick X Liu
(74) *Attorney, Agent, or Firm* — Workman Nydegger

(57) ABSTRACT

A liquid ejecting system includes an environmental information acquiring unit that acquires, as environmental information at least one of a temperature and a humidity, an ejecting unit that ejects a liquid onto a medium, a drying unit that dries the medium onto which the liquid is ejected by the ejecting unit, a control unit that controls the ejecting unit and the drying unit, and a storage unit that stores setting information. The control unit acquires drying information corresponding to medium type information and ejection amount information acquired as a liquid ejection condition and the environmental information acquired by the environmental information acquiring unit, based on the setting information stored in the storage unit, and performs drying control that controls the drying unit, based on the acquired drying information.

7 Claims, 6 Drawing Sheets

IPT

| MEDIUM TYPE | MEDIUM A | | | | | | | | MEDIUM B | | | | | | | |
|---|---|---|---|---|---|---|---|---|---|---|---|---|---|---|---|---|
| PASS COUNT | 1.1 | 1.5 | 2.1 | 2.5 | 3.1 | 4.3 | 5 | 9 | 1.1 | 1.5 | 2.1 | 2.5 | 3.1 | 4.3 | 5 | 9 |
| HEATING SETTING TEMPERATURE | 60 | 60 | 55 | 55 | 50 | 50 | 50 | 50 | 75 | 75 | 75 | 75 | 60 | 60 | 50 | 50 |
| GAP SETTING [1.6, 2.0, 2.5] | 2.0 | | | | | | | | 2.0 | | | | | | | |
| BACK TENSION [Lv1-4] | Lv2 | Lv2 | Lv2 | Lv2 | Lv2 | Lv2 | Lv2 | Lv2 | Lv2 | Lv2 | Lv2 | Lv2 | Lv2 | Lv2 | Lv2 | Lv2 |
| SUCTION FORCE [Off, Lv1-10] | Lv1 | | | | | | | | Lv3 | | | | | | | |
| ROLLER LOAD [Lv1, Lv2, Lv3] | Lv2 | Lv2 | Lv2 | Lv2 | Lv2 | Lv2 | Lv2 | Lv2 | Lv2 | Lv2 | Lv2 | Lv2 | Lv2 | Lv2 | Lv2 | Lv2 |
| FRONT TENSION [Lv1-9] | Lv3 | Lv3 | Lv3 | Lv3 | Lv3 | Lv1 | Lv1 | Lv1 | Lv3 | Lv3 | Lv3 | Lv3 | Lv3 | Lv1 | Lv1 | Lv1 |

FIG. 4

LIQUID EJECTING SYSTEM AND CONTROL METHOD OF LIQUID EJECTING SYSTEM

The present application is based on and claims priority from JP Application Serial Number 2019-140797, filed Jul. 31, 2019, the disclosure of which is hereby incorporated by reference herein in its entirety.

BACKGROUND

1. Technical Field

The present disclosure relates to a liquid ejecting system provided with an ejecting unit that ejects a liquid such as an ink onto a medium such as a sheet, and a control method of a liquid ejecting system.

2. Related Art

For example, JP-A-2003-1876 discloses a liquid ejecting device, such as an inkjet printer, that ejects a liquid such as an ink onto a medium such as a sheet to perform printing. In such a liquid ejecting device, a drying unit is provided that dries the medium onto which the liquid has been ejected, and a degree to which the liquid ejected onto the medium is dried differs depending on a printing environment. For example, in a high-temperature and high-humidity printing environment, a quality of the printing may deteriorate due to an occurrence of wrinkles in the medium, and the like. In this way, in order to inhibit the deterioration of the printing quality, an ejection amount of the liquid corresponding to the printing environment is ejected based on a printing environment characteristics table in which environmental information regarding a type of the medium and the printing environment is associated with the ejection amount of the liquid.

However, in the liquid ejecting device described in JP-A-2003-1876, although the ejection amount of the liquid ejected onto the medium is reduced in the printing environment such as the high-temperature and high-humidity printing environment, the ejection amount of the liquid ejected onto the medium affects color development of a printed material, and there is a risk that the printing quality may deteriorate for a user who places importance on the color development of the printed material, for example.

SUMMARY

A liquid ejecting system that solves the above-described problem includes an environmental information acquiring unit configured to acquire, as environmental information, at least one of a temperature and a humidity, an ejecting unit configured to eject a liquid onto a medium, a drying unit configured to dry the medium onto which the liquid is ejected by the ejecting unit, a control unit configured to control the ejecting unit and the drying unit, and a storage unit configured to store setting information that associates a plurality of parameters including medium type information relating to a type of the medium, the environmental information including at least one of a temperature and a humidity and also including ejection amount information relating to an ejection amount of the liquid per area of the medium, with drying information that is information relating to drying by the drying unit. The control unit acquires, as a liquid ejection condition, the medium type information and the ejection amount information, and performs liquid ejection control that ejects the liquid onto the medium from the ejecting unit, based on the ejection amount information acquired as the liquid ejection condition. The control unit acquires, based on the setting information stored in the storage unit, the drying information corresponding to the medium type information and the ejection amount information acquired as the liquid ejection condition, and the environmental information acquired by the environmental information acquiring unit, and performs drying control that controls the drying unit, based on the acquired drying information.

A control method of a liquid ejecting device that solves the above-described problem includes an environmental information acquiring step for acquiring at least one of a temperature and a humidity, a liquid ejection condition acquiring step for acquiring, as a liquid ejection condition, medium type information relating to a type of the medium and ejection amount information relating to an ejection amount of the liquid ejected per area of the medium, and a liquid ejection control step for ejecting a liquid onto a medium, based on the ejection amount information acquired as the liquid ejection condition in the liquid ejection condition acquiring step. The control method includes a drying information acquiring step for acquiring drying information corresponding to the medium type information and the ejection amount information acquired as the liquid ejection condition in the liquid ejection condition acquiring step, and the environmental information acquired in the environmental information acquiring step, based on setting information that associates a plurality of parameters including the medium type information relating to the type of the medium, the environmental information including at least one of a temperature and a humidity and including the ejection amount information relating to the ejection amount of the liquid per area of the medium, with drying information relating to drying of the medium onto which the liquid is ejected. The control method includes a drying control step for drying the medium onto which the liquid is ejected based on the drying information acquired in the drying information acquiring step.

BRIEF DESCRIPTION OF THE DRAWINGS

FIG. 4 is a schematic view illustrating content of initial parameters of a liquid ejecting device.

DESCRIPTION OF EXEMPLARY EMBODIMENTS

A liquid ejecting device according to an exemplary embodiment will be described below with reference to the accompanying drawings.

Figure 1:
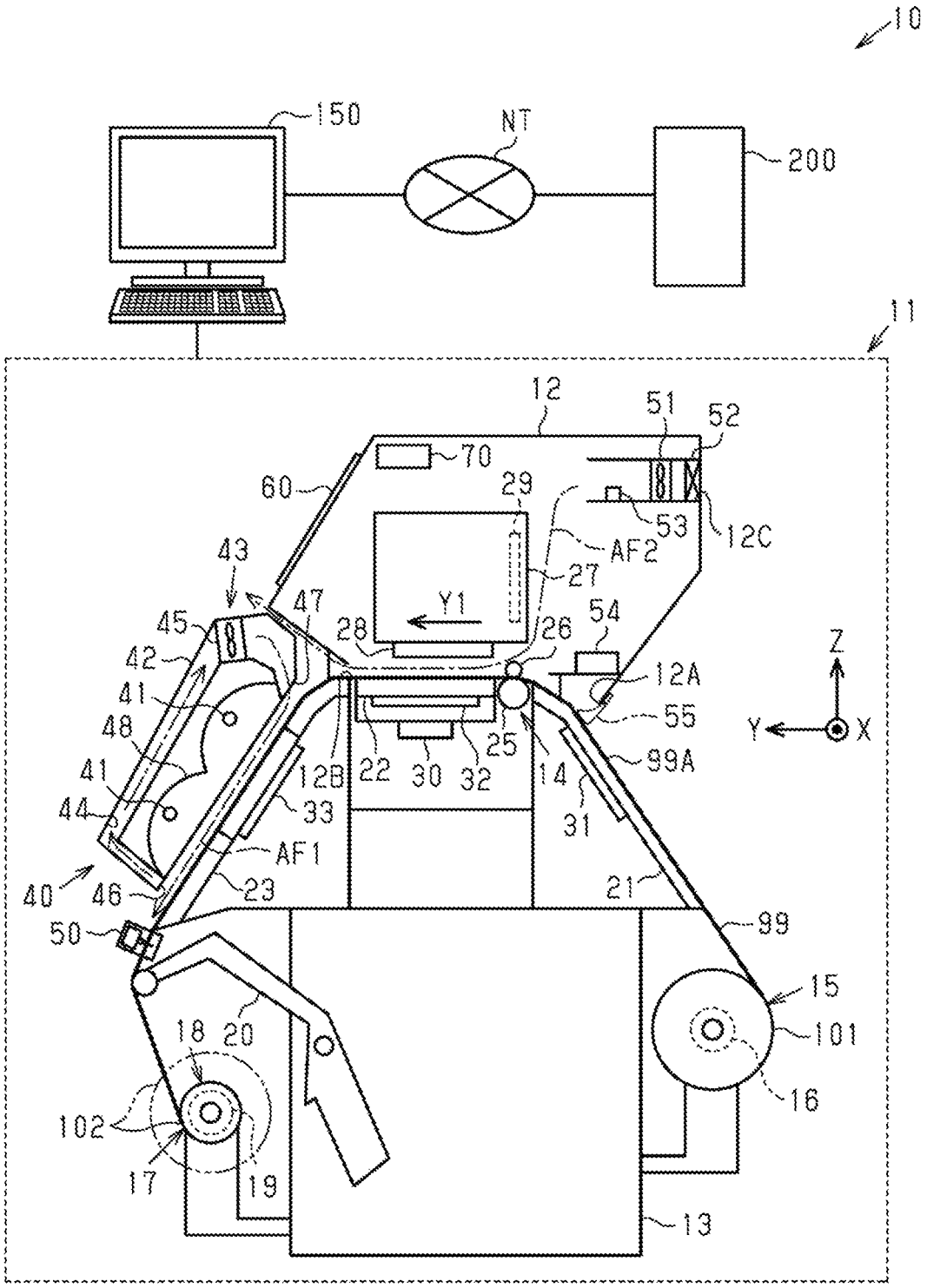
FIG. 1 is a schematic cross-sectional side view illustrating a liquid ejecting system according to an exemplary embodiment.

A liquid ejecting system 10 illustrated in FIG. 1 is provided with a liquid ejecting device 11 that ejects a liquid onto a medium, a host device 150 that manages the liquid ejecting device 11, and a server device 200 that provides various types of information, such as reference data, to the liquid ejecting device 11. The host device 150 is communicably coupled to one or a plurality of the liquid ejecting devices 11. The server device 200 is communicably coupled to one or a plurality of the host devices 150 via a network NT.

The liquid ejecting device 11 is an inkjet-type printer that prints an image, such as characters and a photograph, by ejecting the liquid such as an ink onto a medium such as a sheet. The liquid ejecting device 11 is provided with a housing 12 and a base 13 that supports the housing 12. The housing 12 is an outer casing of the liquid ejecting device 11 that includes a cover (not illustrated) that can be opened and closed. Note that in FIG. 1 and the like, three virtual axes orthogonal to each other are referred to as an X-axis, a Y-axis, and a Z-axis, when it is assumed that the liquid ejecting device 11 is placed on a horizontal surface. The X-axis is a virtual axis parallel with a scanning direction of an ejecting unit 28, which will be described below, and the Y-axis is a virtual axis parallel with a transport direction of a medium 99 in a print region. Further, the Z-axis is a virtual axis parallel with the vertical direction.

The liquid ejecting device 11 includes a transport unit 14 that transports the medium 99. The transport unit 14 is provided inside the housing 12 and transports the medium 99 along a predetermined transport path. The liquid ejecting device 11 is provided with a feeding unit 15 that can support a roll body 101 around which the medium 99, onto which the liquid has not been ejected, is wound. The feeding unit 15 is attached to the base 13, for example, and rotatably supports the roll body 101. In this way, the roll body 101 is supported by the feeding unit 15 outside the housing 12. The feeding unit 15 includes a feeding motor 16 that is driven when the roll body 101 is rotated in a feed direction. The transport unit 14 transports the long medium 99 that is fed out from the roll body 101 by the feeding unit 15.

The liquid ejecting device 11 includes the ejecting unit 28 that ejects the liquid onto the medium 99. The liquid ejecting device 11 of the present example is a serial printer in which the ejecting unit 28 moves in the scanning direction with respect to the medium 99. Thus, the ejecting unit 28 is provided in a lower portion of a movable carriage 27. The ejecting unit 28 is an inkjet-type recording head. A region in which the ejecting unit 28 can eject the liquid with respect to the medium 99 is referred to as the print region, and a direction in which the medium 99 is transported in the print region is referred to as a transport direction Y1. The carriage 27 reciprocates along the X-axis that intersects the transport direction Y1 of the medium 99, with respect to the medium 99 to be transported. As a result of the ejecting unit 28 ejecting the liquid onto the medium 99 while the carriage 27 is moving, an image or the like is printed on the medium 99. The liquid ejecting device 11 includes the ejecting unit 28 and the carriage 27 inside the housing 12. Note that the liquid ejecting device 11 need not necessarily be provided with the carriage 27, and may be a line printer in which the ejecting unit 28 is arranged in a long shape so as to be capable of simultaneously ejecting the liquid over a range spanning the width of the medium 99.

The liquid ejecting device 11 is provided with a winding unit 17 that takes up the medium 99, onto which the liquid has been ejected by the ejecting unit 28, in a roll shape. The winding unit 17 is attached to the base 13, for example. The winding unit 17 is provided with a reel mechanism 18 that can take up the medium 99, on which the printing has been performed by the ejection of the liquid, as a roll body 102. The reel mechanism 18 is provided with a winding motor 19 that is driven when winding the roll body 102.

The liquid ejecting device 11 is provided with a tension bar 20 that applies tension to the medium 99. The tension bar 20 applies the tension to the medium 99 by coming into contact with the medium 99. As a result of the tension bar 20 applying the tension to the medium 99, a transport accuracy of the medium 99 is improved. The tension bar 20 comes into contact with a section of the medium 99 that has passed through a drying device 40 and has not yet been taken up by the winding unit 17. The tension bar 20 is rotatably attached to the base 13, for example.

The liquid ejecting device 11 is provided with an upstream support portion 21, a support portion 22, and a downstream support portion 23 that configure the transport path of the medium 99. The upstream support portion 21, the support portion 22, and the downstream support portion 23 support the medium 99 transported by the transport unit 14. The upstream support portion 21, the support portion 22, and the downstream support portion 23 are located in this order from upstream to downstream of the transport path. The support portion 22 is a platen that supports a section of the medium 99 onto which the liquid is ejected by the ejection of the ejecting unit 28. The support portion 22 is located inside the housing 12. Specifically, the upstream support portion 21 configures an upstream section of the transport path, and supports a section of the medium 99 extending from the feeding unit 15 to the transport unit 14. The support portion 22 configures a middle section of the transport path, and supports a section of the medium 99 that is located downstream of the transport unit 14 while facing the ejecting unit 28. The downstream support portion 23 configures a downstream section of the transport path, and supports, of the medium 99 transported downstream by the transport unit 14, a section after the printing on which the liquid ejected by the ejecting unit 28 has been deposited. In an example illustrated in FIG. 1, the support portion 22 is disposed horizontally, and the upstream support portion 21 and the downstream support portion 23 located on both sides of the support portion 22 in the transport direction are disposed in an inclined state, thereby forming a mountain-shaped transport path having a flat top surface. In this way, the medium 99 is transported from outside the housing 12 to the inside of the housing 12, and the liquid is ejected by the ejecting unit 28 inside the housing 12.

The transport unit 14 includes a driving roller 25 and a driven roller 26. The driving roller 25 and the driven roller 26 transport the medium 99 by rotating in a nipping state in which the medium 99 is clamped therebetween. The driving roller 25 and the driven roller 26 are located between the upstream support portion 21 and the support portion 22 in the transport path. The driving roller 25 transports the medium 99 using a transport motor 77 (see FIG. 3) as a power source. The driving roller 25 and the driven roller 26 are configured by a pair of rollers capable of nipping the medium 99. The driving roller 25 and the driven roller 26 can be switched between a separated state in which they are separated from each other and the nipping state in which the medium 99 is clamped therebetween. Further, in the nipping state in which the driving roller 25 and the driven roller 26 clamp the medium 99 therebetween, a roller load for clamping the medium 99 can be changed in a plurality of stages. The liquid ejecting device 11 is provided with a roller adjustment mechanism 34 that performs switching of the driving roller 25 and the driven roller 26, but may also be provided with an operating lever (not illustrated) that is operated by a user and capable of performing the switching of the driving roller 25 and the driven roller 26.

The ejecting unit 28 is disposed in a position facing the support portion 22. Thus, the ejecting unit 28 ejects the liquid onto the section of the medium 99 supported by the support portion 22. The liquid ejecting device 11 is provided with a gap adjustment mechanism 29 that adjusts a gap between the ejecting unit 28 and the support portion 22. The gap adjustment mechanism 29 adjusts the gap between the ejecting unit 28 and the support portion 22 by moving the carriage 27 along the Z-axis. With this gap adjustment, regardless of the thickness of the medium 99, a gap between the ejecting unit 28 and the medium 99 is adjusted to a value suitable for the printing.

A suction mechanism 30 that sucks the medium 99 to the support portion 22 using a negative pressure is provided below the support portion 22. The suction mechanism 30 causes the negative pressure to act through suction holes 35 (see FIG. 2) that open in a support surface 22A, which is a surface of the support portion 22 supporting the medium 99, and causes the medium 99 to be sucked to the support surface 22A.

Further, the upstream support portion 21, the support portion 22, and the downstream support portion 23 include heaters 31, 32, and 33, respectively. Specifically, a preheater 31 that heats the upstream support portion 21 is provided on a back surface of the upstream support portion 21, a platen heater 32 that heats the support portion 22 is provided on a back surface of the support portion 22, and an after-heater 33 that heats the downstream support portion 23 is provided on a back surface of the downstream support portion 23. The preheater 31 preheats a section of the medium 99 before the printing, using heat of the heated upstream support portion 21. The platen heater 32 heats a section of the medium 99 corresponding to an ejection-receiving region, onto which the liquid is ejected from nozzles 28A of the ejecting unit 28, using heat of the heated support portion 22. The after-heater 33 heats a section the medium 99 after the printing, using heat of the heated downstream support portion 23. Note that each of the heaters 31 to 33 is configured by a planar heater, for example.

For example, the temperature of the preheater 31 and the platen heater 32 is set to approximately 40° C., and the temperature of the after-heater 33 is set to approximately 50° C., which is higher than the temperature of the preheater 31 and the platen heater 32. The preheater 31 gradually increases the temperature of the medium 99 from an ambient temperature toward a heating temperature of the platen heater 32, via the upstream support portion 21. The platen heater 32 heats the medium 99 via the support portion 22, and quickly dries the ink that has landed on the medium 99. The after-heater 33 increases the temperature of the medium 99 to a temperature higher than the heating temperature of the platen heater 32, via the downstream support portion 23, and completely dries and fixes the liquid that has landed on the medium 99 before the medium 99 is taken up by the reel mechanism 18.

The liquid ejecting device 11 is provided with the drying device 40, which is an example of a drying unit that dries the medium 99 onto which the liquid has been ejected by the ejecting unit 28. The drying device 40 is located downstream from a position at which the liquid is ejected by the ejecting unit 28 on the transport path. Thus, the drying device 40 heats and dries the medium 99 on which the liquid has been deposited.

The drying device 40 includes a heater pipe 41 that configures an example of a heating unit. The heater pipe 41 is located facing the downstream support portion 23. The heater pipe 41 heats a print surface of the medium 99 that is transported while being supported by the downstream support portion 23. The heater pipe 41 is controlled to have a predetermined heating setting temperature. In this case, the higher the heating setting temperature, the greater an output of the heater pipe 41 becomes.

The drying device 40 includes a case 42 that houses the heater pipe 41, and a circulation unit 43 that circulates gas inside the case 42. The case 42 opens on a side facing the downstream support portion 23. The circulation unit 43 includes a circulation path 44 through which the gas flows, and an air blowing fan 45 located partway along the circulation path 44. The circulation path 44 is a flow path that connects an air intake port 46 through which the gas is introduced with an air blowing port 47 through which the gas is discharged. The circulation path 44 extends along a path surrounding the heater pipe 41. The air intake port 46 is located facing a downstream portion of the downstream support portion 23. The air blowing port 47 is located facing an upstream portion of the downstream support portion 23. The circulation unit 43 generates a first airflow AF1 by circulating the gas heated by the heater pipe 41 through a path extending both inside the case 42 and along an upper surface of the downstream support portion 23. Specifically, in order to facilitate the drying of the medium 99, some of the gas heated by the heater pipe 41 near the front surface of the medium 99 is introduced from the air intake port 46, then, the introduced gas is heated by the heat from the heater pipe 41 in the course of passing through the circulation path 44, and the heated gas is blown through the air blowing port 47 once again to the front surface of the medium 99 by the air blowing fan 45. The drying device 40 includes a reflecting plate 48 that reflects the heat of the heater pipe 41 toward the downstream support portion 23. The reflecting plate 48 efficiently transmits the heat of the heater pipe 41 to the medium 99.

The liquid ejecting device 11 is provided with a cutting device 50 that cuts the medium 99. The cutting device 50 is located in a position downstream of the drying device 40 in the transport direction. In the liquid ejecting device 11, a selection can be made between a winding method in which the medium 99 after the printing is wound as the roll body 102, and a cutting method in which the medium 99 after the printing is not wound but is cut to a predetermined size by the cutting device 50. The cutting device 50 includes, for example, a movable blade and a fixed blade, and the movable blade moves along the X-axis to cut the medium 99 to the predetermined size.

A fan 51 that sucks the outside air into the housing 12 is provided in the housing 12. The fan 51 introduces air filtered through a filter 52, from an air intake port 12C provided in the housing 12, into the housing 12. A second airflow AF2 that is introduced into the housing 12 is discharged mainly from a discharge port 12B to the outside of the housing 12, passing through the periphery of a movement region of the ejecting unit 28. As a result of the air inside the housing 12 being ventilated by the clean air, foreign matter floating in the housing 12 is removed.

Further, the liquid ejecting device 11 is provided with a humidity detector 53 as an example of an environmental information acquiring unit that detects the humidity. In the present example, the humidity detector 53 is provided inside the housing 12. The humidity detector 53 detects the humidity of the air introduced from the outside of the housing 12 at a position, inside the housing 12, downstream of the fan 51 in an air intake direction of the fan 51.

The humidity detector 53 of the present example is configured by a temperature and humidity sensor capable of detecting the temperature in addition to the humidity. The temperature and humidity sensor detects the humidity and the temperature of the outside air in the vicinity of the air intake port 12C of the outside air into the housing 12. In other words, the humidity detector 53 acquires the temperature and the humidity of the outside of the housing 12. The humidity detector 53 is located inside the housing 12 in an upper portion thereof, as opposed to the lower portion in which the ejecting unit 28 is located. Here, the lower portion of the interior of the housing 12 tends to have a relatively high humidity due to an effect of water vapor and the like evaporated from the liquid deposited on the medium 99 immediately after the printing. Further, in the lower portion of the interior of the housing 12, the temperature of the outside air cannot be accurately detected due to an effect of heat from a heat source, such as the platen heater 32. Thus, the temperature and humidity sensor configuring the humidity detector 53 detects the humidity and the temperature of the air from the outside of the housing 12 at an upper position inside the housing 12, where the humidity detector 53 is less likely to be affected by the above-described water vapor and heat source. Note that the humidity detector 53 may be attached to an outside surface of the housing 12.

Further, in the liquid ejecting device 11, a dust catcher 55 is mounted on a feeding port 12A as necessary, through which the medium 99 is fed into the housing 12. The dust catcher 55 is disposed upstream of the ejecting unit 28 in the transport direction Y1, and comes into contact with a section of a print surface 99A onto which the liquid has not yet been ejected from the ejecting unit 28. The dust catcher 55 comes into contact with the print surface 99A while substantially covering the feeding port 12A. The dust catcher 55 removes foreign matter, such as dust and fluff, adhered to the print surface 99A, and also prevents the air, in which the foreign matter is floating, from flowing into the housing 12 through the feeding port 12A. The dust catcher 55 is attached to a predetermined position near the feeding port 12A of the housing 12, using a magnet or a screw. The dust catcher 55 of the present example is configured to be capable of controlling a pressing force that presses against the print surface 99A.

Further, a display unit 60 is provided on an outer surface of the housing 12. Various types of messages and the like for the user are displayed on the display unit 60, in addition to various types of menu screen, an input screen for printing condition information, and the like. The liquid ejecting device 11 is provided with a control unit 70. The control unit 70 controls the transport unit 14, the feeding unit 15, the winding unit 17, the ejecting unit 28, the carriage 27, the drying device 40, the display unit 60, and the like.

The liquid ejecting device 11 is used by selecting one of a winding method, illustrated in FIG. 1, in which the dried medium 99 after the printing is wound, and a non-winding method in which the dried medium 99 after the printing is not wound. In the non-winding method, the medium 99 after the printing is cut to the predetermined size by the cutting device 50, or is discharged while maintaining the long shape without being cut.

Figure 2:
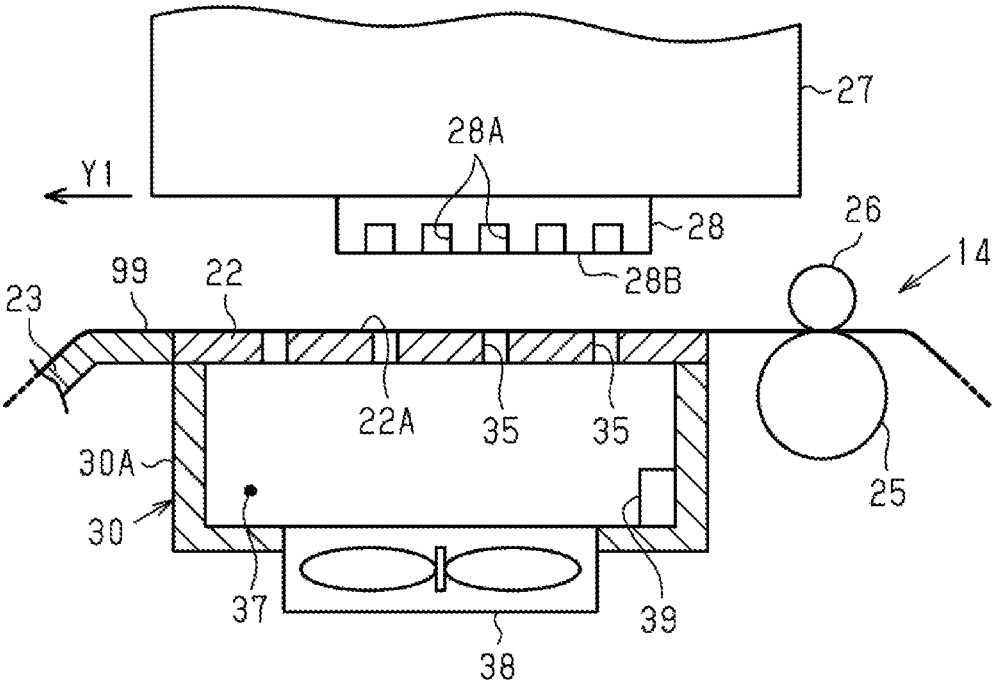
FIG. 2 is a schematic cross-sectional side view illustrating a suction mechanism.

Next, a detailed configuration of the suction mechanism 30 will be described with reference to FIG. 2. As illustrated in FIG. 2, the support portion 22 includes the suction holes 35 that open in the support surface 22A supporting the medium 99. The liquid ejecting device 11 includes the suction mechanism 30 that generates the negative pressure that causes a suction force for sucking the medium 99 to act through the suction holes 35. A negative pressure chamber forming member 30A is assembled to a lower portion of the support portion 22. Then, a negative pressure chamber 37 is formed as a result of being surrounded by the support portion 22 and the negative pressure chamber forming member 30A. The suction holes 35 penetrate through the support portion 22 and are communicated with the negative pressure chamber 37. The plurality of suction holes 35 that are communicated with the negative pressure chamber 37 are open in the support surface 22A. The suction mechanism 30 is provided with an exhaust fan 38 that discharges air in the negative pressure chamber 37 to the outside. When the exhaust fan 38 is driven, the air in the negative pressure chamber 37 is discharged to the outside, and a pressure inside the negative pressure chamber 37 becomes a negative pressure. Accordingly, the section of the medium 99 supported by the support portion 22 is sucked to the support surface 22A by the suction force generated by the negative pressure acting on the plurality of suction holes 35 that are open in the support surface 22A.

In the liquid ejecting device 11, at the time of printing when the liquid is ejected from the ejecting unit 28 and an image is printed on the medium 99, if there is a risk of wrinkles or lifting occurring in the medium 99, the exhaust fan 38 is driven, and the medium 99 is sucked to the support surface 22A. A pressure sensor 39 that detects a pressure is provided inside the negative pressure chamber 37. Based on the detected pressure detected by the pressure sensor 39, the control unit 70 controls the suction mechanism 30 so that the pressure inside the negative pressure chamber 37 is a predetermined set negative pressure value. In the present exemplary embodiment, the negative pressure acts on the suction holes 35 even when the medium 99 is transported, and the suction force that sucks the medium 99 to the support surface 22A acts on the medium 99 that is being transported. The suction force that causes the medium 99 to be sucked to the support surface 22A increases a transport load of the medium 99, and sometimes causes wrinkles to be generated, due to the increased transport load. Thus, while the control unit 70 drives the suction mechanism 30 to suppress the generation of the wrinkles under a humidity environment in which the wrinkles or the like may be generated in the medium 99, under other circumstances, the control unit 70 performs the printing in a state in which the suction mechanism 30 is stopped. Note that the control unit 70 may perform control in which the negative pressure does not act through the suction holes 35 when the medium 99 is being transported.

When the humidity outside the housing 12 is high, wrinkles are easily generated in the medium 99 on which the ejected liquid is deposited. This is due to the following reasons. When the humidity outside the housing 12 is high, moisture contained in the medium 99 increases. In other words, when the humidity increases, a moisture content of the medium 99 before the printing increases. When the moisture content of the medium 99 increases, a total moisture content of the medium 99 immediately after the printing, on which the liquid ejected from the ejecting unit 28 is deposited, increases. In other words, even when an ejection amount of the ejected liquid is the same, the total moisture content of the medium 99 immediately after the printing is higher at a second humidity than at a first humidity, where the second humidity is higher than the first humidity. When the total moisture content of the medium 99 immediately after the printing increases, it becomes more difficult to dry the medium 99 on which the liquid is deposited, and an elongation amount of the medium 99 that occurs when fibers of the medium 99 absorb the liquid and swell, also increases. Further, a contraction amount of the medium 99 that occurs when the significantly swollen and elongated medium 99 contracts in the drying process also increases, and, as a result, the wrinkles are more easily generated.

The wrinkles that are generated in the section of the medium 99 on which the printing has been already performed may spread upstream, in the transport direction Y1, and may reach the section of the medium 99 facing the ejecting unit 28. In this case, when the wrinkles rub against a nozzle opening surface 28B of the ejecting unit 28, a printing failure occurs in which the medium 99 is contaminated by the ink. Thus, when the humidity detector 53 detects a humidity that exceeds an upper limit value of a humidity range suitable for the printing, the control unit 70 performs control to suppress the generation of the wrinkles. Note that the control performed by the control unit 70 will be described below in detail.

Figure 3:
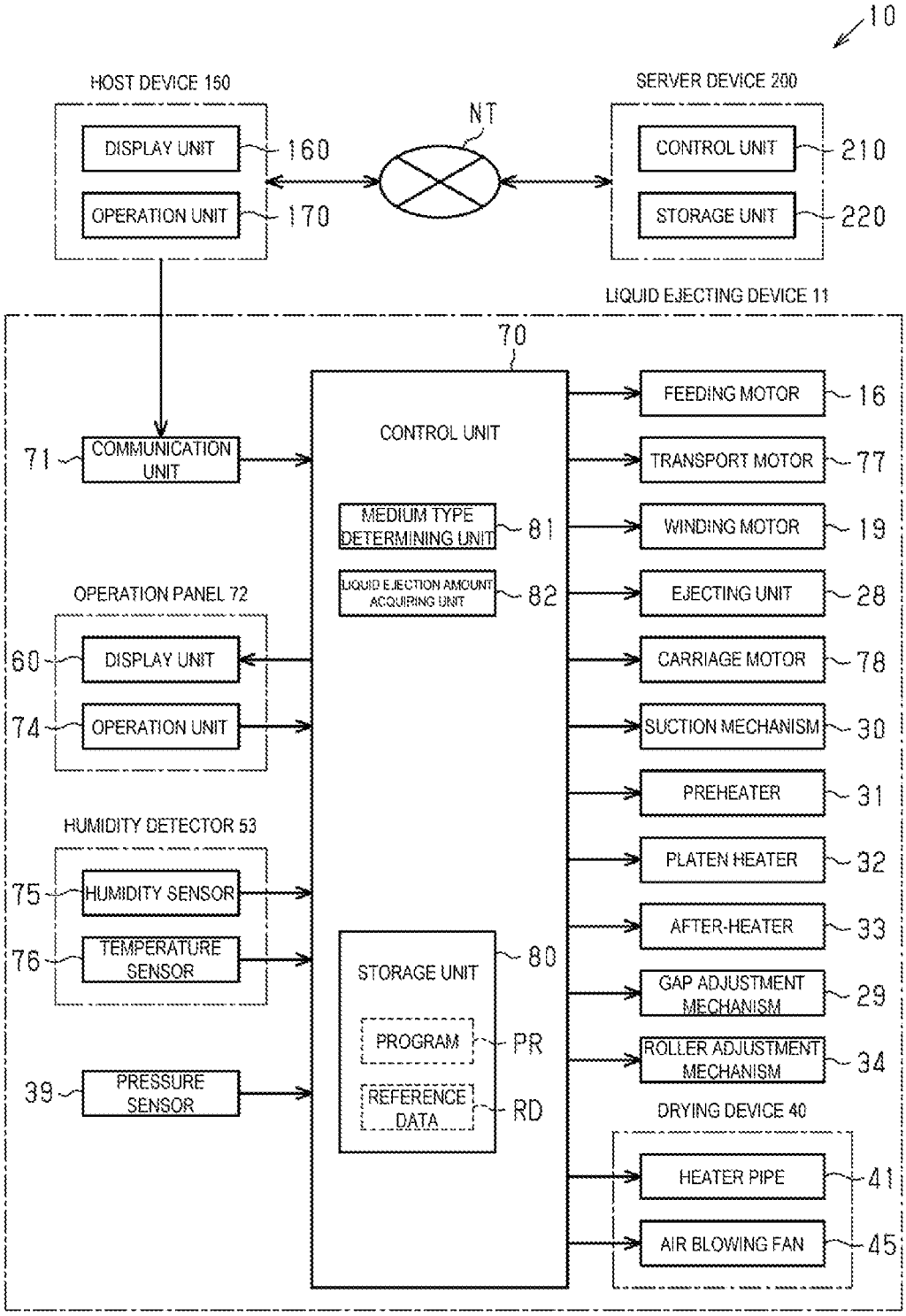
FIG. 3 is a block diagram illustrating an electrical configuration of the liquid ejecting system.

Next, an electrical configuration of the liquid ejecting device 11 will be described below with reference to FIG. 3. The liquid ejecting device 11 is provided with the control unit 70. The control unit 70 is electrically coupled to a communication unit 71, an operating panel 72, the humidity detector 53 that detects the humidity outside the housing 12, and the pressure sensor 39 that detects the pressure in the negative pressure chamber 37 of the suction mechanism 30. The operation panel 72 is provided with the display unit 60 and an operation unit 74. When the display unit 60 is a touch panel, the operation unit 74 may be configured by an operational function portion of the touch panel.

The control unit 70 is communicably coupled to the host device 150 via the communication unit 71. The host device 150 is provided with a display unit 160 and an operation unit 170 operated by the user. The host device 150 includes a print driver (not illustrated) that generates print job data when the user operates the operating unit 170 to issue an instruction to perform the printing. Hereinafter, the "print job" will also simply be referred to as a "job." The control unit 70 receives the job data from the host device 150 via the communication unit 71. Note that the host device 150 is configured by any one of a personal computer, a personal digital assistant (PDA), a tablet PC, a smart phone, a mobile phone, and the like.

Further, the host device 150 and the server device 200 are communicably coupled to each other via the network NT. The server device 200 is provided with a control unit 210, which is an example of a server control unit, and a storage unit 220. In the server device 200, reference data for controlling the liquid ejecting device 11 is stored in the storage unit 220 for each of models of the liquid ejecting device 11. When a transmission condition is met, the control unit 210 transmits the reference data to the host device 150 via the network NT. When the user operates the operating unit 170 to issue an instruction to perform settings, the host device 150 transmits received setting information to the liquid ejecting device 11. The control unit 70 receives the reference data from the host device 150 via the communication unit 71 and stores the reference data in a storage unit 80.

When printing control is performed, the control unit 70 transmits historical information, which is controlled based on reference data RD, to the host device 150 via the communication unit 71. The host device 150 transmits the received historical information to the server device 200 via the network NT. In the server device 200, when the historical information regarding how the liquid ejecting device 11 has been controlled is input from the host device 150, the control unit 210 cumulatively stores the historical information in the storage unit 220 as a database.

The humidity detector 53 includes a humidity sensor 75 that detects a relative humidity outside the housing 12, and a temperature sensor 76 that detects a temperature outside the housing 12. The humidity detector 53 of the present example is configured by a temperature and humidity sensor in which the humidity sensor 75 and the temperature sensor 76 are integrated into a single sensor unit. The humidity detector 53 calculates an absolute humidity AH in accordance with a predetermined calculation formula using information about a relative humidity RH (%) detected by the humidity sensor 75 and a temperature T (° C.) detected by the temperature sensor 76. The absolute humidity AH is calculated in accordance with the calculation formula, that is, $AH=217\times e(T)/(T+273.15)\times RH/100$. Here, e(T) is a saturation vapor pressure and is expressed using Teten's formula, that is, $e=6.11\times 10\hat{}(7.5\ T/(T+237.3))$. The symbol "^" indicates a power. Note that the humidity detector 53 may be configured by including a portion (a humidity calculation unit) of the control unit 70, which calculates the absolute humidity AH from each value of the humidity and the temperature respectively detected by the humidity sensor 75 and the temperature sensor 76. Further, the humidity detector 53 may be configured by separately including the humidity sensor 75 and the temperature sensor 76, instead of the temperature and humidity sensor. Furthermore, one or both of the humidity sensor 75 and the temperature sensor 76 may be provided outside the housing 12.

The control unit 70 inputs, via an input interface (not illustrated), an operation signal generated when the operating unit 74 is operated, a humidity detection value detected by the humidity sensor 75, a temperature detection value detected by the temperature sensor 76, an absolute humidity detection value detected by the humidity detector 53 based on information about the humidity and the temperature, and a pressure detection signal of the pressure sensor 39.

Further, the control unit 70 is electrically coupled to the feeding motor 16, the transport motor 77, the winding motor 19, the ejecting unit 28, a carriage motor 78, the suction mechanism 30, the preheater 31, the platen heater 32, the after-heater 33, the gap adjustment mechanism 29, and the roller adjustment mechanism 34. In addition, the heater pipe 41 and the air blowing fan 45, which configure the drying device 40, are electrically coupled to the control unit 70. The transport motor 77 is a drive source of the driving roller 25 configuring the transport unit 14. The carriage motor 78 is a drive source of the carriage 27. Note that when the liquid ejecting device 11 is the line printer, the electrical configuration of the liquid ejecting device 11 is a configuration illustrated in FIG. 3 from which the carriage motor 78 is removed.

The control unit 70 receives, from the host device 150, the job data instructing the continuous printing of a single image or of a plurality of images. The job includes various types of commands required for the printing control, the printing condition information specified by the user, and print image data. The printing condition information, which is an example of a liquid ejection condition, includes medium type information indicating a medium type, which is a type of the medium 99, and ejection amount information indicating an average ejection amount, which is an amount of the liquid per area of the medium ejected by the ejecting unit 28. In particular, the ejection amount information includes pass count information indicating a number of scans, which is a number of times the ejecting unit 28 moves over the same region of the medium 99 while ejecting the liquid. A single scan, in which the ejecting unit 28 moves while ejecting the liquid while the carriage 27 is reciprocating along the X-axis during the printing, is referred to as a pass. The pass count corresponds to a number of the passes, which is a number of the single scans performed by the ejecting unit 28. During each of the passes, the ejecting unit 28 forms dots at different positions in the same region. Depending on the pass count, a density of the dots formed by the liquid ejected onto the same region varies. Thus, the greater the pass count, the higher a number of printed pixels per unit area of the medium, and the higher the resolution of the printing. On the other hand, the greater the pass count, the greater the number of times the ejecting unit 28 scans the same region of the medium 99, and thus, the slower the transport speed of the medium 99 becomes.

In this way, the pass count is a parameter that both indicates the ejection amount information relating to the liquid ejection amount, and medium transport speed information relating to the transport speed of the medium 99. The pass count and the transport speed have an approximately inversely proportional relationship. Further, a drying time, during which the drying device 40 dries the medium 99 after the printing, is inversely proportional to the transport speed. In other words, the drying time is approximately proportional to the pass count. In this regard, the pass count is a parameter that also indicates drying time information relating to the drying time during which the drying device 40 dries the medium 99 after the printing.

In the present exemplary embodiment, the ejecting unit 28 performs gradation printing in which a plurality of different volumes (sizes) of droplets are ejected. For example, the printing is performed at four gradations, namely, large dots, medium dots, small dots, and no dots. When the pass count is small, the large dots are printed at a low resolution in which the dots are formed at a low density, and when the pass count is large, the small dots and the medium dots are mixed and printed at a high resolution in which the dots are formed at a high density. The high resolution printing may be performed with the small dots only. Here, when the pass count increases, the dot size tends to decrease, but a number of the dots per unit area of the medium increases. Thus, if the print image data is the same, when the pass count increases, the average ejection amount indicating the liquid ejection amount per area of the medium tends to increase. The average ejection amount is a value obtained by dividing a total ejection amount of the liquid ejected onto the medium 99 by the area of the medium 99.

Note that the gradation printing may be three-gradation printing in which the large dots and the small dots are formed, and a number of the gradations may be changed as appropriate. Further, a configuration may be employed in which the dots are formed using only one type of the dot size without employing the gradation printing. Regardless of the number of gradations used in the gradation printing or whether or not the gradation printing is employed, when the pass count increases, the average ejection amount always tends to increase. Further, although the liquid ejection amount per area of the medium ejected onto the medium 99 also varies depending on the print image data, for example, depending on different brightness settings of the print image data, when the pass count increases, the average ejection amount always tends to increase.

Thus, a first liquid ejection amount, which is the liquid ejection amount per area of the medium when the pass count is a first pass count, is greater than a second liquid ejection amount, which is the liquid ejection amount per area of the medium when the pass count is a second pass count, which is smaller than the first pass count. Further, a first transport speed, which is the transport speed of the medium 99 when the pass count is the first pass count, is slower than a second transport speed, which is the transport speed when the pass count is the second pass count, which is smaller than the first pass count. In addition, the lower the transport speed of the medium 99, the longer the drying time during which the medium 99 after the printing passes through the drying region of the drying device 40. Thus, a first drying time, which is the drying time when the pass count is the first pass count, is longer than a second drying time, which is the drying time when the pass count is the second pass count, which is smaller than the first pass count.

The control unit 70 controls various types of motors, such as the motors 16, 19, and 77, based on the printing condition information included in the job, and, by controlling the ejecting unit 28 based on the print image data and ejecting the liquid from the nozzles 28A, forms an image using the dots formed by the droplets landing on the medium 99. Note that the host device 150 may transmit the printing condition information and the print image data separately to the control unit 70 at different timings. For example, when the user operates the operation unit 170 of the host device 150 to input the medium type information and the pass count information, the host device 150 transmits the accepted information to the control unit 70 each time the host device 150 accepts the input. When the user instructs the operation unit 170 to start the printing, the host device 150 that has accepted the instruction transmits the specified print image data to the control unit 70. In this case, the control unit 70 receives the medium type information, the pass count information, and the print image data separately at different timings.

The control unit 70 drives the gap adjustment mechanism 29 in accordance with the medium type obtained from the printing condition information to displace the carriage 27 along the Z-axis, and adjusts the gap between the ejecting unit 28 and the support portion 22 to a value corresponding to the medium type. As a result, the gap between the ejecting unit 28 and the medium 99 is adjusted to a suitable value corresponding to the medium type. When "high definition printing" having a high printing resolution is required, the control unit 70 adjusts the gap between the ejecting unit 28 and the support portion 22 to a first gap in order to increase a dot positioning accuracy of the ejecting unit 28. On the other hand, when "standard printing" having a low printing resolution is required, the control unit 70 adjusts the gap to a second gap, which is larger than the first gap, in order to prioritize the printing speed over the dot positioning accuracy of the ejecting unit 28. Further, the greater the pass count, the higher the printing resolution becomes. Thus, the control unit 70 may adjust the gap based on the pass count. Note that the gap adjustment mechanism 29 adopts either a mechanical drive system in which the control unit 70 causes the carriage 27 to reciprocate in a predetermined section within the movement region and causes the carriage 27 to operate a drive lever (not illustrated) to mechanically drive the gap adjustment mechanism 29, or an electric drive method in which a dedicated motor is driven to adjust the gap.

Figure 7:
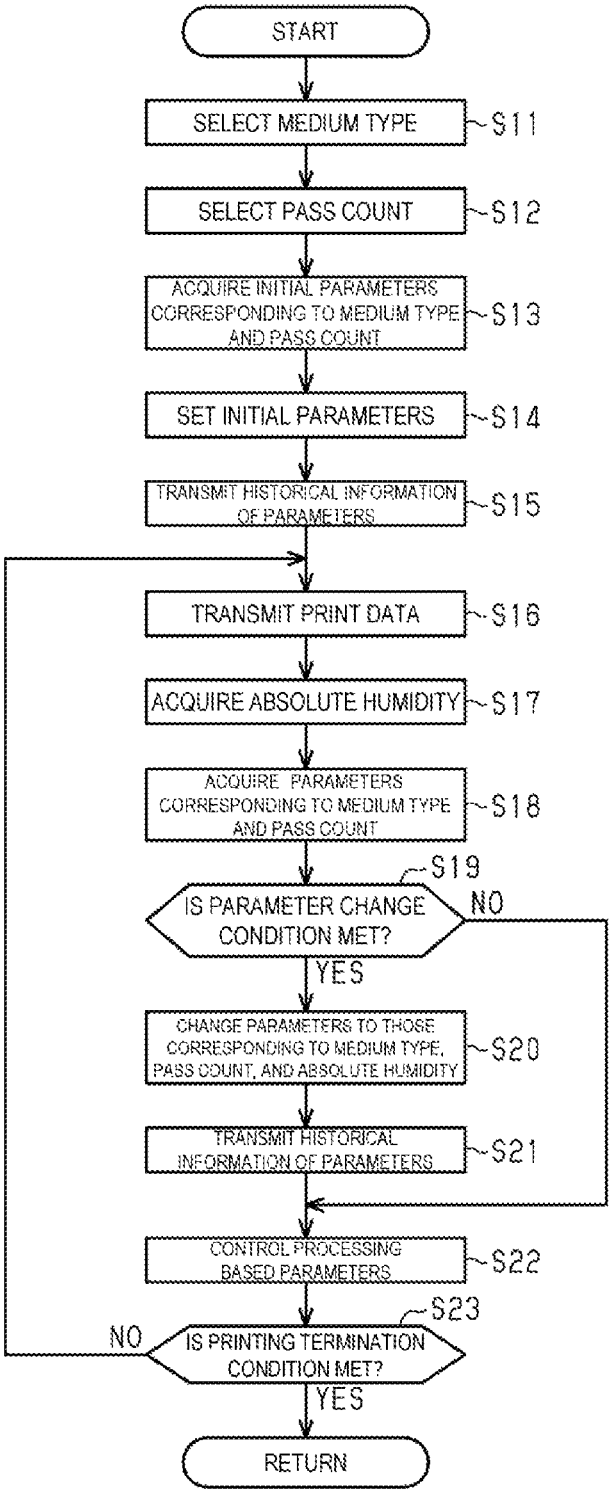
FIG. 7 is a flowchart illustrating a control sequence for performing control based on environmental information during printing.

The control unit 70 is provided with a CPU, an application specific integrated circuit (ASIC), and the storage unit 80 (memory) configured by a RAM, a nonvolatile memory, and the like. The CPU performs various types of control, including the printing control, by executing control programs stored in the storage unit 80. The storage unit 80, which is an example of a liquid ejecting device storage unit, stores a program PR of a control sequence illustrated in a flowchart in FIG. 7, and the reference data RD that is referenced based on the detection result detected by the humidity detector 53 in the control sequence, the program PR being included in the control programs. The CPU of the control unit 70 executes the program PR after a power supply to the liquid ejecting device 11 is turned on. Further, by referring to the reference data RD that is based on the absolute humidity AH detected by the humidity detector 53, the control unit 70 sets setting parameters suitable for performing the printing at the detected absolute humidity AH. Further, the control unit 70 is provided with a medium type determining unit 81 and a liquid ejection amount acquiring unit 82 as functional units that function by executing the program PR.

The medium type determining unit 81 determines the medium type that is the type of the medium 99. The medium type determining unit 81 determines the medium type based on the medium type information in the printing condition information included in the job. Examples of the medium type include plain paper, glossy paper, matte paper, and the like. Further, the medium type information includes basis weight information relating to the medium thickness. Thus, the medium type determining unit 81 determines the medium type not only based on the type, such as the plain paper and the glossy paper, but also by distinguishing the medium type as thin paper, thick paper, and the like, while classifying the type based on the medium thickness using the basis weight information.

The liquid ejection amount acquiring unit 82 acquires the ejection amount information, which is the average ejection amount per area of the medium, of the liquid ejected by the ejecting unit 28. The liquid ejection amount acquiring unit 82 calculates a total amount (g) of the liquid to be ejected onto a single image based on the image data included in the job, and divides the total amount of the liquid by the area of the medium (mm^2) on which the image is printed, in order to acquire the average ejection amount (g/mm^2). A value obtained by dividing the average ejection amount by a maximum ejection amount (g/mm^2) is multiplied by "100" to obtain the average ejection amount (%). For example, in solid printing with no margin, in which the ink is deposited on an entire image region, the average ejection amount is 100%.

Note that, in a state in which the medium 99 is set in the transport unit 14 after the power supply is turned on, when the control unit 70 accepts an instruction to start a reel measurement, the control unit 70 performs the reel measurement. In the reel measurement, in a state in which no tension is acting on the medium 99, a winding load is measured that is applied when the medium 99 is taken up by the winding unit 17. Then, the control unit 70 calculates a target rotational torque for controlling the winding motor 19 by adding a torque conversion value of a target tension that is to be applied to the medium 99 in accordance with the medium type and the medium width, to a torque conversion value of the winding load obtained from the measurement result of the reel measurement. By controlling the winding motor 19 using the calculated target rotational torque, the control unit 70 applies a front tension, which is a tension that acts on a region, between the transport unit 14 and the roll body 102, of the medium 99 that is being taken up.

Further, by controlling a transport amount by which the transport unit 14 transports the medium 99 and a feed amount by which the feeding unit 15 feeds the medium 99 from the roll body 101, the control unit 70 applies a back tension, which is a tension that acts on a region, between the roll body 101 and the transport unit 14, of the medium 99. Specifically, by transporting the medium 99 while generating micro slippage on the rollers by performing the control so as to cause the feed amount to be slightly less than the transport amount, the control unit 70 applies the back tension to the medium 99.

In the liquid ejecting device 11 of the present example, the liquid ejected from the ejecting unit 28 is a water-based ink, for example. Thus, during the heating and drying process, in which the medium 99 on which the ejected liquid has been deposited is heated to be dried, water vapor is generated by water contained in the liquid being evaporated. Further, when the medium 99 is a sheet, for example, the medium 99 onto which the ejected liquid has been deposited stretches as a result of the fibers of the sheet absorbing the liquid and swelling, and after that, contracts as a result of the moisture evaporating and the medium 99 being dried in the heating and drying process. At this time, the elongation and contraction amounts of the medium 99 depend on the medium type and the average ejection amount (%). Note that a solvent or a dispersion medium contained in the liquid may be a water soluble organic solvent. Further, the solvent or the dispersion medium may be a water insoluble organic solvent.

Here, the absolute humidity, which is an example of environmental information, is a density of water vapor contained in the atmosphere. In contrast, an amount of moisture (an amount of saturation vapor), which can be contained in the air in the form of water vapor, is a constant value determined in accordance with the temperature under atmospheric pressure. When the limit is 100, a numerical value indicating what percentage (%) of the amount of moisture is actually contained in the air in relation to the maximum limit is the relative humidity (% RH).

The absolute humidity AH affects how easily the medium 99 after the printing is dried by the drying device 40. Depending on the medium type and the average ejection amount (the pass count, for example), an optimum heating temperature range suitable for drying is determined. The optimum heating temperature range is defined by a lower limit value and an upper limit value of the range. The optimum heating temperature range is affected by the absolute humidity AH. That is, the optimum heating temperature range changes depending on the absolute humidity AH. Here, even when the optimum heating temperature range corresponding to the medium type and the pass count changes due to a change within an assumed range of the absolute humidity AH, it is sufficient that the heating setting temperature be set within a range in which the optimum heating temperature ranges for each of the absolute humidities AH before and after the change overlap with each other. The heating setting temperature satisfying this condition is set as an initial value in the present exemplary embodiment. However, if the absolute humidity AH changes beyond the assumed range, the heating setting temperature may fall outside the optimum heating temperature range, which changes depending on the absolute humidity AH. If the heating setting temperature falls outside the optimum heating temperature range corresponding to the absolute humidity AH at that time, the following problem occurs.

When the humidity is high with the high absolute humidity AH, the medium 99 absorbs the moisture in the atmosphere, and the moisture content increases. Then, the total amount of moisture in the medium 99 on which the liquid has been deposited increases. Thus, even when the drying by the drying device 40 is completed, the medium 99 is unlikely to be sufficiently dried. Further, when the total amount of moisture in the medium 99 on which the liquid has been deposited increases, the elongation and contraction amounts when the medium 99 swells and contracts increase. When the medium 99 is not sufficiently dried, the medium 99 does not fully contract from the swollen and elongated state near to the original dimension thereof, and slackening and wrinkles are easily generated in the medium 99. On the other hand, when the humidity is low with the low absolute humidity AH, the moisture content of the medium 99 is reduced as a result of the medium 99 discharging the moisture into the atmosphere, and the total amount of moisture in the medium 99 on which the liquid has been deposited is reduced. Thus, the medium 99 is excessively heated by the drying device 40. When the medium 99 is excessively heated, the medium 99 itself is subjected to thermal contraction, and wrinkles are easily generated in the medium 99.

The upper limit value and the lower limit value of such an optimum heating temperature range differ depending on the model of the liquid ejecting device 11, because printing conditions are different depending on the model. Further, even with the same single model, the upper limit value and the lower limit value differ depending on the medium type and the pass count. In particular, even when the liquid is ejected onto the same medium type of the medium 99 with the same pass count in the same model of the liquid ejecting device 11, the initial heating setting temperature may fall outside the optimum heating temperature range, which changes depending on the absolute humidity AH, and this makes it easier for the printing failure to occur.

Thus, by referring to a parameter setting table in which parameters are specified including heating setting temperature information corresponding to the medium type information, the pass count, and the absolute humidity AH, it is possible to perform control to make it less likely for the printing failure to occur. Further, in addition to the parameter setting table, an initial parameter setting table for setting initial parameters is provided. Note that the heating setting temperature information will be described later.

The initial parameter setting table is stored in the storage unit 80 of the liquid ejecting device 11 as the reference data RD. Here, the initial parameter setting table will be described.

As illustrated in FIG. 4, an initial parameter setting table IPT is stored in the storage unit 220 of the server device 200 for each of model information of the liquid ejecting device 11. The initial parameter setting table IPT corresponding to the model information of the liquid ejecting device 11 is downloaded to the host device 150 via the network NT from the server device 200 in response to an operation of the operating unit 170, and as a result of being transmitted from the host device 150 to the liquid ejecting device 11, the initial parameter setting table IPT is stored in the storage unit 80 of the liquid ejecting device 11 as the reference data RD. The initial parameter setting table IPT is a table that is referenced when the job is received from the host device 150.

In the initial parameter setting table IPT, the heating setting temperature information, gap setting information, back tension information, suction force information, roller load information, and front tension information are associated with the medium type information and the pass count information.

The medium type information is information indicating the type of the medium 99 onto which the liquid is ejected, and corresponds to the medium type information included in the printing condition information of the job. Although only two medium types, namely, a "medium A" and a "medium B" are illustrated in FIG. 4, a predetermined number of the medium types, in a range of 5 to 30 medium types, for example, are set. The pass count information is information relating to the number of scans indicating how many of the passes are performed over the same region of the medium, the pass being one movement of the ejecting unit 28 moving in the scanning direction along the X-axis while ejecting the liquid. The pass count information is information indicating, using the number of scans, the liquid ejection amount, per area of the medium, of the liquid ejected by the ejecting unit 28, and corresponds to the pass count included in the ejection amount information of the printing condition information of the job. Here, when a unit length is a length of nozzle rows of the nozzles of the ejecting unit 28, which are formed in rows along the transport direction in the nozzle opening surface in which the nozzles are open, the term "unit area of the medium" in the "liquid ejection amount, per area of the medium, of the liquid ejected" corresponds to an area of the medium 99 corresponding to the unit length in the transport direction of the medium 99.

The heating temperature setting, which is an example of drying information, is information indicating the heating setting temperature that is set to heat the medium 99 using the heater pipe 41 of the drying device 40. In an example illustrated in FIG. 4, a surface temperature of the medium 99 that is heated by the drying device 40 is set as the heating setting temperature. Here, the surface temperature of the medium 99 is defined as a temperature at a peak position at which the medium 99, which is transported through the drying region of the drying device 40, reaches the highest temperature as a result of the heating. The peak position is identified, for example, from a position of the temperature sensor obtained when the temperature sensor detects the highest temperature when being transported at a constant speed while being attached to the front surface of the dry medium 99. As the constant speed, for example, the lowest possible transport speed, of the transport speeds used for the printing, is used.

The control unit 70 heats the heater pipe 41 by causing a current having a current value obtained based on the heating setting temperature to pass through the heater pipe 41. This current value is a value that takes into account an air blowing intensity of the air blowing fan 45, and is set so that the surface temperature of the medium 99 becomes the heating setting temperature as a result of being heated by the heater pipe 41 and hot air from the air blowing fan 45. The control unit 70 may perform heating control of the drying device 40 using a feed-forward control, but may perform the heat control using a feedback control based on a detection temperature by a temperature sensor (not illustrated) that detects a temperature in the drying region of the drying device 40 or in the vicinity of the drying region. The temperature sensor may be a non-contact temperature sensor, such as an infrared sensor, provided in the drying device 40 and capable of detecting the surface temperature of the medium 99 in a non-contact manner, or a temperature sensor, such as a thermistor, which indirectly detects the surface temperature of the medium 99 by detecting a temperature of the back surface of the downstream support portion 23 heated by the after-heater 33.

The gap setting information is information indicating the gap between the ejecting unit 28 and the support portion 22 that is adjusted by the gap adjustment mechanism 29. When the gap between the ejecting unit 28 and the support portion 22 is determined, the gap between the ejecting unit 28 and the medium 99 is determined. The back tension information is information indicating the back tension applied to the medium 99. The back tension refers to a tension applied to a section of the medium 99 located upstream in the transport direction from a nipping position at which the driving roller 25 and the driven roller 26 clamp the medium 99. The suction force information is information indicating the suction force that is applied by the suction mechanism 30 so as to cause the medium 99 to move in a direction approaching the support portion 22. The roller load information is information indicating a load at which the driving roller 25 and the driven roller 26 clamp the medium 99. The front tension information is information indicating the front tension applied to the medium 99. The front tension refers to a tension applied to a section of the medium 99 located between the nipping position of the driving roller 25 and the driven roller 26, and the roll body 102 mounted on the winding unit 17.

In this way, by referencing the initial parameter setting table IPT, the control unit 70 acquires, as the initial parameters, the heating setting temperature information, the gap setting information, the back tension information, the suction force information, the roller load information, and the front tension information corresponding to the medium type information and the pass count information included in the job. Then, the printing is started based on the acquired initial parameters.

The parameter setting table is stored in the storage unit 80 of the liquid ejecting device 11 as the reference data RD. Here, the parameter setting table will be described.

The parameter setting table, which is an example of setting information and a setting table, is stored in the storage unit 220 of the server device 200 for each of the model information of the liquid ejecting device 11. The parameter setting table corresponding to the model information of the liquid ejecting device 11 is downloaded to the host device 150 via the network NT from the server device 200 in response to the operation of the operating unit 170, and as a result of being transmitted from the host device 150 to the liquid ejecting device 11, the parameter setting table is stored in the storage unit 80 of the liquid ejecting device 11 as the reference data RD. The parameter setting table is a table that is referenced during the printing after the job is received from the host device 150 and the printing is started.

In the parameter setting table, a plurality of parameters including the medium type information, the pass count information, and the absolute humidity are associated with the heating setting temperature information, the gap setting information, the back tension information, the suction force information, the roller load information, and the front tension information. When the medium type information and the pass count information included in the printing condition information of the job, and the absolute humidity detected by the humidity detector 53 are acquired in this way, the parameter setting table is referenced. Then, the heating setting temperature information, the gap setting information, the back tension information, the suction force information, the roller load information, and the front tension information corresponding to the medium type information, the pass count information, and the absolute humidity can be acquired. In this way, in the storage unit 220, a parameter setting table PT is stored that associates the model information of the liquid ejecting device 11, the medium type information, the absolute humidity AH, and the path count information with the heating setting temperature. Then, the control unit 210 transmits the parameter setting table PT corresponding to the model information to the liquid ejecting device 11, and the control unit 70 causes the storage unit 80 to store the parameter setting table PT from the server device 200.

Figure 5:
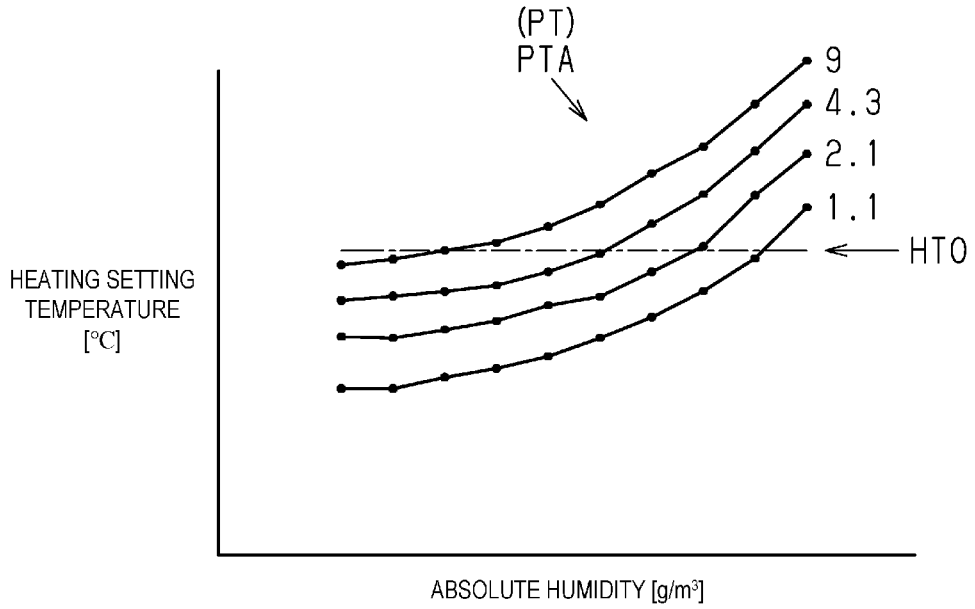
FIG. 5 is a graph illustrating an absolute humidity and a heating setting temperature when a medium type A is used.
Figure 6:
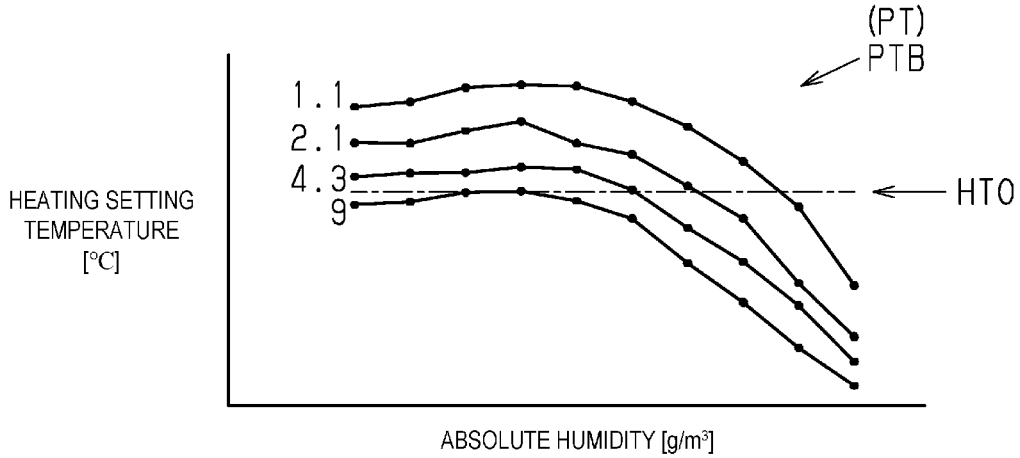
FIG. 6 is a graph illustrating the absolute humidity and the heating setting temperature when a medium type B is used.

Here, relationships of the medium type, the pass count and the absolute humidity with the heating setting temperature will be described. FIGS. 5 and 6 are graphs illustrating correspondence relationships of the medium type, the pass count, and the absolute humidity with the heating setting temperature, in the parameter setting table PT referenced by the control unit 70. Such correspondence relationships are set, for example, based on results of test data. FIG. 5 and FIG. 6 illustrate graphs for a plurality of representative pass counts, namely, "1.1" "2.1" "4.3" and "9" with the horizontal axis indicating the absolute humidity (g/cm^3) and the vertical axis indicating the heating setting temperature (° C.). Here, a value after the decimal point of the pass count means a ratio of a portion of a unit region, onto which the liquid has been ejected by a N+1th pass, after the liquid has been ejected onto the entire unit region by a Nth pass, for example. FIG. 5 is a graph illustrating a first parameter setting table PTA, which is a section of the parameter setting table PT referenced when the medium A is selected as the medium type, and FIG. 6 is a graph illustrating a second parameter setting table PTB, which is a section of the parameter setting table PT referenced when the medium B is selected as the medium type. Note that in FIG. 5 and FIG. 6, the heating setting temperature indicated by dot-dash lines is the initial heating setting temperature that is set in the initial parameter setting table IPT. This initial heating setting temperature is a constant value regardless of the value of the absolute humidity.

As illustrated in FIG. 5, when the medium type is the medium A, the heating setting temperature information corresponds to the absolute humidity for each of the pass counts. When the medium type is the medium A, when the pass count is the same, the higher the absolute humidity, the higher the heating setting temperature information becomes, and when the absolute humidity is the same, the higher the pass count, the higher the heating setting temperature information becomes.

On the other hand, as illustrated in FIG. 6, in a case in which the medium type is the medium B also, the heating setting temperature information corresponds to the absolute humidity for each of the pass counts. When the medium type is the medium B, when the pass count is the same, the higher the absolute humidity, the lower the heating setting temperature information becomes, and when the absolute humidity is the same, the higher the pass count, the lower the heating setting temperature information becomes.

In this way, by the control unit 70 referencing the parameter setting table PT, various parameters, including the heating setting temperature information corresponding to the medium type information and the pass count information included in the job and to the absolute humidity acquired by the humidity detector 53, are acquired as the setting parameters. Then, the printing is continued based on the acquired setting parameters.

When the heating setting temperature is changed to a higher value due to a change in the absolute humidity AH, there is a possibility that the heating has been insufficient up to that point. Thus, there is a concern that wrinkles may be generated due to insufficient drying of the medium 99. This type of wrinkle becomes a winding wrinkle when the medium 99 is wound around the roll body 102, which is mounted on the winding unit 17. Thus, when the absolute humidity changes in a direction that causes the heating setting temperature to be higher, the value of the front tension information is reduced. However, a control for reducing the front tension may be performed only when the diameter of the roll body 102 exceeds a threshold value. On the other hand, when the heating setting temperature is changed to a lower value due to a change in the absolute humidity, there is a possibility that the heating has been excessive to that point. Thus, there is a concern that wrinkles may be generated due to thermal contraction of the medium 99. Thus, when the absolute humidity changes in a direction that causes the heating setting temperature to be lower, as a countermeasure against the wrinkles at a time of excessive heating, the value of the gap setting information, the value of the back tension information, and the value of the suction force information are increased. However, for the thin medium 99 having a thickness less than a threshold value, such as the thin paper, it is preferable not to change the value of the suction force information, because the wrinkles may be generated as a result of the transport load of the medium 99 being increased by the suction force causing the medium 99 to be sucked to the surface of the support portion 22. In this way, the parameter setting table PT includes a section in which, even when the medium type information and the pass count information have the same values, if the absolute humidity is different, different values are set as the values of the heating setting temperature information, the gap setting information, the back tension information, the suction force information, and the front tension information corresponding to the absolute humidity.

The control sequence performed by the control unit 70 will be described below. After the power supply to the liquid ejecting device 11 is turned on, the control unit 70 performs the control sequence illustrated in the flowchart in FIG. 7.

First, at step S11, in accordance with the operation of the operation unit 74 or the instruction from the host device 150, the control unit 70 selects the medium type onto which the liquid is to be ejected, from the printing condition information of the job, and causes the storage unit 80 to store the medium type information indicating the selected medium type. In this way, the control unit 70 acquires the medium type information relating to the type of the medium as the printing condition information. Note that in the present exemplary embodiment, the processing at step S11 corresponds to an example of a liquid ejection condition acquiring step.

At step S12, in accordance with the operation of the operation unit 74 or the instruction from the host device 150, the control unit 70 selects the pass count to be applied when the liquid is ejected, from the printing condition information of the job, and causes the storage unit 80 to store the selected pass count information. In this way, the control unit 70 acquires, as the printing condition information, the ejection amount information including the pass count information relating to the ejection amount of the liquid per area of the medium. Note that in the present exemplary embodiment, the processing at step S12 corresponds to an example of the liquid ejection condition acquiring step.

At step S13, with reference to the initial parameter setting table IPT stored in the storage unit 80, the control unit 70 acquires the initial parameters corresponding to the medium type information and the pass count information. Then, at step S14, the control unit 70 causes the storage unit 80 to store the selected initial parameters as the setting parameters. Those setting parameters include the heating setting temperature information, the gap setting information, the back tension information, the suction force information, the roller load information, and the front tension information. For example, when the heating setting temperature information is set as the setting parameter, the control unit 70 acquires the initial heating setting temperature information as the initial parameter corresponding to the medium type information and the pass count information, with reference to the initial parameter setting table IPT stored in the storage unit 80, and causes the storage unit 80 to store the initial heating setting temperature information as the setting parameter.

At step S15, the control unit 70 transmits the historical information of the parameters stored in the storage unit 80 as the setting parameters, to the host device 150. In addition to the setting parameters that have been set, the historical information includes unique identification information of the liquid ejecting device 11, the model information, the medium type information, and the pass count information. After being transmitted to the host device 150, the historical information is transmitted to the server device 200 via the network NT. In the server device 200, the control unit 210 causes the storage unit 220 to cumulatively store the received historical information as a database.

At step S16, the control unit 70 transmits print data to the ejecting unit 28 based on the ejection amount information included in the printing condition information. As a result, the control unit 70 causes the ejecting unit 28 to eject the liquid based on the ejection amount information including the pass count information, which is the printing condition information. Note that in the present exemplary embodiment, the processing at step S16 corresponds to an example of a liquid ejection control step. Further, in the present exemplary embodiment, control for causing the ejecting unit 28 to eject the liquid onto the medium 99 corresponds to an example of the liquid ejection control step.

Then, at step S17, the control unit 70 acquires the absolute humidity AH detected by the humidity detector 53. Alternatively, the control unit 70 may acquire the absolute humidity AH by performing a predetermined calculation based on the relative humidity RH detected by the humidity sensor 75 configuring the humidity detector 53, and the temperature T (° C.) detected by the temperature sensor 76. In this way, the control unit 70 acquires the absolute humidity AH from the humidity detector 53 as the environmental information. Note that in the present exemplary embodiment, the processing at step S17 corresponds to an example of an environmental information acquiring step.

At step S18, by referencing the parameter setting table PT stored in the storage unit 80, the control unit 70 acquires the parameters including the heating setting temperature information corresponding to the medium type information, the pass count information, and the absolute humidity AH. Then, at step S19, the control unit 70 determines whether or not a parameter change condition has been met. When the currently set setting parameters are different from the parameters acquired at step S18, the parameter changing condition is met. For example, when the heating setting temperature information is changed, the control unit 70 acquires a plurality of the parameters including the heating setting temperature information corresponding to the medium type information, the path count information, and the absolute humidity AH, with reference to the parameter setting table PT stored in the storage unit 80, and compares the plurality of parameters with the heating setting temperature information stored in the storage unit 80 as the setting parameter. In this case, the control unit 70 determines that the parameter change condition has been met when the acquired heating setting temperature information does not match the heating setting temperature information stored in the storage unit 80 as the setting parameter. If the parameter change condition is met, the control unit 70 advances the processing to step S20, and if the parameter change condition is not met, the control unit 70 advances the processing to step S22.

At step S20, when the parameters acquired at step S18 are different from the setting parameters stored in the storage unit 80, the control unit 70 causes the storage unit 80 to store the parameters acquired at step S18 as the setting parameters, and changes the parameters to the parameters including the heating setting temperature information corresponding to the medium type information, the pass count information, and the absolute humidity AH. For example, when the heating setting temperature information is changed, the parameters including the heated setting temperature information to be changed are stored in the storage unit 80 as the setting parameters. In this way, based on the parameter setting table PT, the control unit 70 acquires the heating setting temperature information corresponding to the medium type information and the pass count information acquired as the printing condition information, and the absolute humidity AH detected by the humidity detector 53. Note that in the present exemplary embodiment, the processing at step S20 corresponds to an example of a drying information acquiring step.

At step S21, the control unit 70 transmits, to the host device 150, the historical information of the parameters stored in the storage unit 80 as the setting parameters. In addition to the setting parameters that have been set, the historical information includes unique identification information of the liquid ejecting device 11, the model information, the medium type information, and the pass count information. After being transmitted to the host device 15, the historical information is transmitted to the server device 200 via the network NT. In the server device 200, the control unit 210 causes the storage unit 220 to cumulatively store the received historical information as the database. In this way, the control unit 70 transmits, to the server device 200, the model information of the liquid ejecting device 11, the medium type information and the pass count information acquired as the printing condition information, the absolute humidity AH acquired by the humidity detector 53, and the heating setting temperature controlled by the drying device 40, as the historical information. Then, the control unit 210 of the server device 200 causes the storage unit 220 to store the historical information from the liquid ejecting device 11.

At step S22, the control unit 70 performs control based on the setting parameters stored in the storage unit 80. For example, when the heating setting temperature information is used as an example of the setting parameter, the control unit 70 acquires the heating setting temperature information stored in the storage unit 80, and controls the drying device 40 based on the acquired heating setting temperature information. Note that in the present exemplary embodiment, the processing at step S22 corresponds to an example of a drying control step. Further, in the present exemplary embodiment, control for drying the medium 99 onto which the liquid has been ejected, using the drying device 40, corresponds to an example of controlling drying.

At step S23, the control unit 70 determines whether or not a print termination condition for terminating the printing is met. If the print termination condition is not met, the control unit 70 advances the processing to step S16 and performs the processing from step S16 to step S22 repeatedly. When the print termination condition is met, the control unit 70 terminates the execution of the control sequence. By repeatedly performing the processing from step S16 to step S22 until the printing termination condition is met in this way, even when the absolute humidity AH changes during the printing, the control unit 70 can change the setting parameters including the heating setting temperature information in accordance with the change in the absolute humidity AH.

Next, an operation of the liquid ejecting device 11 will be described. The initial parameter setting table IPT and the parameter setting table PT are stored in the storage unit 220 of the server device 200. Further, the initial parameter setting table IPT and the parameter setting table PT are transmitted from the server device 200 to the liquid ejecting device 11 via the network NT and the host device 150, and also stored in the storage unit 80 of the liquid ejecting device 11.

The medium 99 is supported, as the roll body 101, by the feeding unit 15 outside the housing 12, and is transported into the housing 12. When the job is transmitted from the host device 150 to the liquid ejecting device 11, the initial parameter setting table IPT is referenced, and the initial parameters corresponding to the medium type information and the pass count included in the printing condition information of the job are stored in the storage unit 80 as the setting parameters. Then, the parameter setting table PT is referenced, and the parameters including the heating setting temperature information corresponding to the absolute humidity AH acquired by the humidity detector 53 is acquired in addition to the medium type information and the pass count. Then, the acquired parameters are stored in the storage unit 80 as the setting parameters.

As a result, regardless of the absolute humidity AH, the liquid is ejected from the ejecting unit 28 based on the medium type information and the pass count information. Further, the drying device 40, the gap adjustment mechanism 29, the roller adjustment mechanism 34, and the motors 16, 19, and 77 are controlled based on the setting parameters corresponding to the medium type information, the pass count information, and the absolute humidity AH. In particular, as a result of the heater pipe 41 of the drying device 40 being controlled based on the heating setting temperature corresponding to the medium type information, the pass count information, and the absolute humidity AH, the drying device 40 can be controlled at a temperature corresponding to the moisture content of the medium 99.

After an initial heating setting temperature HT0 corresponding to the pass count information illustrated in FIG. 5 and FIG. 6 is set, when the heating setting temperature corresponding to the medium type information, the pass count information, and the absolute humidity AH detected by the humidity detector 53 differs from the initial heating setting temperature HT0, the heating setting temperature is updated. After that, when the absolute humidity AH changes, and the heating setting temperature corresponding to the medium type information, the pass count information, and the absolute humidity AH detected by the humidity detector 53 differs from the current (most recently stored) heating setting temperature stored in the storage unit 80, the heating setting temperature is updated to the latest heating setting temperature acquired this time.

In the case of the medium type A illustrated in FIG. 5, when the absolute humidity AH changes in a decreasing direction, the heating setting temperature is changed in the decreasing direction. Further, in the case of the medium type B illustrated in FIG. 6, when the absolute humidity AH changes in an increasing direction, the heating setting temperature is changed in the decreasing direction. In those cases, if the initial heating setting temperature HT0 is maintained as it is, the medium 99 is excessively heated due to the low moisture content of the medium 99. As a result, although the liquid deposited on the medium 99 is sufficiently dried, the medium 99 thermally contracts to an excessive degree, and the wrinkles are generated in the medium 99 due to the thermal contraction.

This type of wrinkle occurs in the drying region of the drying device 40 and extends upstream in the transport direction as it grows. In the case of a setting having a high pass count, the transport speed of the medium 99 is slow and the drying time during which the medium 99 stays in the drying region of the drying device 40 increases. Thus, the wrinkles sometimes grow and extend up to a recording region of the ejecting unit 28. In this case, there is a concern about the occurrence of the printing failure in which the wrinkles, which have grown up to the recording region, come into contact with the ejecting unit 28 and the medium 99 is contaminated with the liquid. To avoid this, a method may be used in which the gap between the ejecting unit 28 and the support portion 22 is increased so as to prevent the wrinkles from coming into contact with the ejecting unit 28. However, by increasing the gap, a flight distance of the droplets ejected from the nozzles of the ejecting unit 28 is increased, and this leads to a deterioration in landing position accuracy of the droplets with respect to the medium 99.

In contrast, in the present exemplary embodiment, in the case of the medium type A illustrated in FIG. 5, when the absolute humidity AH changes in the decreasing direction, the heating setting temperature is changed in the decreasing direction. Therefore, in this case, even when the moisture content of the medium 99 is low at a low humidity, the heating setting temperature is changed to be low accordingly. Thus, the excessive heating of the medium 99 can be avoided. As a result, the liquid deposited on the medium 99 is sufficiently dried, and also, the generation of the wrinkles caused by the excessive thermal contraction of the medium 99 can be inhibited. For example, even when the transport speed becomes slow and the drying time in the drying region of the drying device 40 becomes relatively long due to a setting having a relatively high pass count, the wrinkles are not generated, or even when the wrinkles are generated, they do not grow and reach the recording region of the ejecting unit 28. Therefore, it is not necessary to take the measure to increase the gap. Thus, with an appropriate gap, the landing position accuracy of the droplets increases, and the high-quality printed material can thus be obtained.

On the other hand, in the case of the medium type A illustrated in FIG. 5, when the absolute humidity AH changes in the increasing direction, the heating setting temperature changes in the increasing direction. Further, in the case of the medium type B illustrated in FIG. 6, when the absolute humidity AH changes in the decreasing direction, the heating setting temperature changes in the increasing direction. In those cases, if the initial heating setting temperature HT0 is maintained as it is, the medium 99 is not sufficiently dried due to the high moisture content of the medium 99. Thus, the medium 99 is in a swollen and elongated state due to the liquid remaining in the insufficiently dried medium 99, and the medium 99 slackens easily. As a result, the slackening and wrinkles are easily generated in the medium 99. This type of wrinkle becomes a cause of the winding wrinkle, which is generated as a result of the wrinkle being folded over when the medium 99 is wound around the roll body 102 mounted on the winding unit 17.

In contrast, in the present exemplary embodiment, in the case of the medium type A illustrated in FIG. 5, when the absolute humidity AH changes in the increasing direction, the heating setting temperature is changed in the increasing direction. In this case, although the moisture content of the medium 99 is increased due to the high humidity, since the heating setting temperature is changed to be higher than the initial heating setting temperature HT0, the liquid deposited on the medium 99 is sufficiently dried. Thus, the slackening and wrinkles, which are caused by the medium 99 being in the swollen and elongated state due to the liquid remaining in the insufficiently dried medium 99, can be inhibited from occurring in the medium 99. As a result, it is possible to inhibit the occurrence of the winding wrinkles, which are generated as a result of the wrinkles being folded over when the medium 99 is wound around the roll body 102 mounted on the winding unit 17.

Further, in the case of the medium type B illustrated in FIG. 6, when the absolute humidity AH changes in the decreasing direction, the heating setting temperature is changed in the increasing direction. Further, in the case of the medium type B illustrated in FIG. 6, when the absolute humidity AH changes in the increasing direction, the heating setting temperature is changed in the decreasing direction. Even in a case of the medium 99 having special characteristics such as the medium B, the liquid deposited on the medium 99 can be sufficiently dried without generating the wrinkles in the medium 99.

As described above in detail, according to the present exemplary embodiment, the following advantageous effects can be obtained.

(1) The liquid ejecting system 10 is provided with the humidity detector 53 that acquires the absolute humidity AH, the ejecting unit 28 that ejects the liquid onto the medium 99, the drying device 40 that dries the medium 99 onto which the liquid has been ejected by the ejecting unit 28, the control unit 70 that controls the ejecting unit 28 and the drying device 40, and the storage unit 220 that stores the parameter setting table PT. The parameter setting table PT is the table that associates the plurality of parameters including the medium type information relating to the type of the medium 99, the absolute humidity AH acquired by the humidity detector 53, and the pass count information relating to the ejection amount of the liquid per area of the medium, with the heating setting temperature relating to the drying by the drying device 40. Then, when the medium type information and the pass count information are acquired as the printing condition information, the control unit 70 performs the liquid ejection control for ejecting the liquid onto the medium 99 from the ejecting unit 28 based on the pass count information acquired as the printing condition information. Further, when the medium type information and the pass count information are acquired as the printing condition information, based on the parameter setting table PT, the control unit 70 acquires the heating setting temperature corresponding to the acquired medium type information and pass count information and the absolute humidity AH acquired by the humidity detector 53, and performs the drying control for controlling the drying device 40 based on the acquired heating setting temperature. Thus, of the medium type information and the pass count information included in the printing condition information and the absolute humidity AH acquired by the humidity detector 53, even when at least the absolute humidity AH changes, the medium 99 onto which the liquid has been ejected can be dried by the drying device 40 that is controlled based on the heating setting temperature corresponding to the medium type information, the pass count information, and the absolute humidity AH. Therefore, because the liquid can be ejected onto the medium 99 with the specified pass count without changing the pass count in accordance with the absolute humidity AH, a deterioration in the quality of the printed material can be suppressed, and it is also possible to perform the printing in accordance with the medium type information, the absolute humidity AH, and the pass count. As a result, it is possible to make it less likely for the wrinkles or the like to be generated in the medium 99.

(2) In particular, the ejecting unit 28 is configured to move in the scanning direction while ejecting the liquid, and the ejection amount information relating to the ejection amount, per area of the medium, of the liquid ejected by the ejecting unit 28 is the pass count information indicating the number of scans in each of which the liquid is ejected onto the same region of the medium 99 by the ejecting unit 28. The pass count is a parameter that affects both the quality of the printing and the transport speed of the medium 99, and by using this parameter, it is possible to make it even less likely for the wrinkles or the like to be generated in the medium 99. When the pass count information is large, compared with when the pass count information is small, the ejection amount of the liquid increases, and a number of liquid ejections per area of the medium increases. As a result, the transport speed of the medium is reduced, and the drying time of the medium 99 by the drying device 40 is increased. Thus, by adopting the pass count information that affects the ejection amount of the liquid and the drying time of the medium 99 as the liquid ejection amount information, remarkable effects are achieved.

(3) The parameter setting table PT is stored in the storage unit 220 of the server device 200. The parameter setting table PT is transmitted from the server device 200 to the liquid ejecting device 11, and the parameter setting table PT is stored in the storage unit 80 of the liquid ejecting device 11. Thus, the parameter setting table PT is easily updated.

(4) Further, when a method is chosen in which the medium 99 and information such as the parameter setting table corresponding to the liquid ejecting device 11 are provided as a set for the user, if the model of the liquid ejecting device 11 is changed, for example, the parameter setting table cannot be applied to another model of the liquid ejecting device 11, for example, which makes it difficult to handle a new model of the liquid ejection device 11. Further, when the information such as the parameter setting table is stored in the liquid ejecting device 11, it is difficult to handle a new type of the medium 99. Thus, by adopting the configuration in which the parameter setting table PT is transmitted from the server device 200, in which the parameter setting table is easily updated, to the liquid ejecting device 11, it becomes easy to handle the new model of the liquid ejecting device 11 and the new type of the medium 99. Of course, even with the same model of liquid ejecting device 11 and the same type of the medium 99, in order to perform precise control, the parameter setting table may need correction. Even in this case, by adopting the configuration in which the parameter setting table is transmitted from the server device 200 to the liquid ejecting device 11, the parameter setting table is easily updated.

(5) In particular, in comparison to the ejecting unit 28, in the drying device 40, depending on the model of the liquid ejecting device 11, a relationship between the absolute humidity AH and the heating setting temperature information varies, for example, due to an acquisition position of the absolute humidity AH by the humidity detector 53, a degree of influence of the outside air, and the like. Thus, in the drying device 40, there may be variations in the heating setting temperature to be set. Therefore, in comparison to the ejection amount information, the heating setting temperature is a parameter by which the quality of the printed material is easily affected depending on the model of the liquid ejecting device 11. Thus, by having the function of transmitting the parameter setting table PT from the server device 200 to the liquid ejecting device 11, even more remarkable effects are achieved.

(6) The control unit 70 causes the storage unit 220 of the server device 200 to store, as the historical information, the medium type information and the pass count information acquired as the printing condition information, the absolute humidity AH acquired by the humidity detector 53, and the heating setting temperature controlled by the drying device 40. Thus, the medium type information, the absolute humidity AH, the pass count information, and the heating setting temperature at a time of the liquid being ejected onto the medium 99 can be analyzed based on the historical information stored in the storage unit 220.

(7) The liquid ejecting system 10 is provided with the liquid ejecting device 11 and the server device 200 capable of communicating with the liquid ejecting device 11 via the network NT. The liquid ejecting device 11 includes the ejecting unit 28, the humidity detector 53, the drying device 40, and the control unit 70, and the server device 200 includes the control unit 210 and the storage unit 220. Then, the control unit 70 additionally transmits the model information of the liquid ejecting device 11 to the server device 200 as the historical information, and the control unit 210 causes the storage unit 220 to store the historical information from the liquid ejecting device 11. In this way, the history information can be stored in the storage unit 220 of the server device 200 in a consolidated manner so that the model information of the liquid ejecting device 11 can be identified.

(8) The storage unit 220 of the server device 200 stores, as the setting information, the parameter setting table PT that associates the model information of the liquid ejecting device 11, the medium type information, the absolute humidity AH, and the pass count information with the heating setting temperature. The control unit 210 of the server device 200 transmits the parameter setting table PT corresponding to the model of the liquid ejecting device 11 to the liquid ejecting device 11. The control unit 70 causes the storage unit 80 to store the parameter setting table PT from the server device 200, acquires the heating setting temperature corresponding to the medium type information, the absolute humidity AH, and the pass count information based on the parameter setting table PT stored in the storage unit 80, and controls the drying device 40 based on the acquired heating setting temperature. Thus, the storage unit 220 stores the parameter setting table PT corresponding to the model information, and as a result of the parameter setting table PT being transmitted to the liquid ejecting device 11, the storage unit 220 can share the parameter setting table PT stored in the server device 200 with the liquid ejecting device 11.

(9) Further, since the drying of the medium 99 onto which the liquid has been ejected is affected by the model of the liquid ejecting device 11, the type of the medium, and the absolute humidity AH in a complex manner, the historical information stored in the storage unit 220 of the server device 200 is analyzed, and more precise control can thus be performed.

(10) In particular, in comparison to the ejecting unit 28, the drying device 40 is structurally or functionally different depending on the model of the liquid ejecting device 11, and variations may thus occur in the heating setting temperature to be set. Thus, in comparison to the ejection amount information, the heating setting temperature is the parameter by which the quality of the printed material can be easily affected depending on the model of the liquid ejecting device 11, and thus, by having the function of transmitting the historical information from the liquid ejecting device 11 to the server device 200, the even more remarkable effects are achieved.

(11) Further, the parameter setting table PT is not transmitted from the server device 200 to the liquid ejecting device 11 in response to every change in the absolute humidity AH, but the parameter setting table PT is transmitted from the server device 200 to the liquid ejecting device 11 in response to the operation of the operating unit 170. Thus, responsiveness to the change in the absolute humidity AH can be improved.

(12) Further, information associating the absolute humidity with the heating setting temperature is stored in the storage unit 80 of the liquid ejecting device 11. Thus, the control unit 70 does not perform communication with the server device 200 every time the control unit 70 acquires the heating setting temperature, but can acquire the heating setting temperature corresponding to the absolute humidity from the storage unit 80. Then, accordingly, an amount of the communication between the liquid ejecting device 11 and the server device 200 can be reduced.

(13) The housing 12 internally includes the ejecting unit 28, and the medium 99 is transported from the outside of the housing 12 to the interior of the housing 12. Further, the humidity detector 53 acquires the absolute humidity AH outside the housing 12. Thus, before the medium 99 is transported from the outside to the interior of the housing 12, the medium 99 is disposed outside the housing 12. Therefore, by acquiring the absolute humidity AH outside the housing 12 in which the medium 99 is disposed, an accuracy of the heating setting temperature can be improved, and it is possible to make it less likely for the wrinkles or the like to be generated in the medium 99.

(14) A control method of the liquid ejecting system 10 includes the environmental information acquiring step in which the absolute humidity AH is acquired, and the liquid ejection condition acquiring step in which the medium type information relating to the type of the medium and the pass count information relating to the ejection amount of the liquid per area of the medium are acquired as the printing condition information. The control method of the liquid ejecting system 10 further includes the liquid ejection control step in which the liquid is ejected onto the medium based on the pass count information acquired as the liquid ejection condition in the liquid ejection condition acquiring step. The control method of the liquid ejecting system 10 further includes the drying information acquiring step in which, based on the parameter setting table PT, the medium type information and the pass count information acquired as the printing condition information in the liquid ejection condition acquiring step, and the absolute humidity AH acquired in the environmental information acquiring step. The control method of the liquid ejecting system 10 further includes the drying control step in which the medium 99 onto which the liquid has been ejected is dried based on the heating setting temperature acquired in the drying information acquiring step. According to this method, the same effects as in (1) are obtained.

Note that the above-described exemplary embodiment may be modified as the following modified examples. Further, the above-described exemplary embodiment can be combined with the modified examples to be described below as appropriate to configure another modified example, or the modified examples to be described below can be combined with each other to configure another modified example.

In the above-described exemplary embodiment, any one of the gap setting information, the back tension information, the suction force information, the roller load information, and the front tension information may be mechanically set instead of being electrically controlled. Further, any one of the gap setting information, the back tension information, the suction force information, the roller load information, and the front tension information need not necessarily be set as the setting parameter other than the heating setting temperature information.

The parameter setting table may be configured by a parameter setting table unique to each of the models of the liquid ejecting device 11 and a parameter setting table common to a plurality of the models of the liquid ejecting device 11.

The parameter setting table may be configured by a parameter setting table unique to each of the medium types and a parameter setting table common to the medium types. For example, since the heating setting temperature information corresponding to the absolute humidity AH is unique to each of the medium types and does not have any commonality among the medium types, a parameter setting table for correcting the heating setting temperature information corresponding to the absolute humidity AH may be adopted as the parameter setting table unique to each of the medium types.

The initial parameter setting table need not necessarily be provided. The control unit 70 can acquire the drying information with reference to the parameter setting table PT based on the medium type information, the environmental information, and the ejection amount information.

An order in which the liquid ejection control and the drying control is performed is not limited.

In the above-described exemplary embodiment, the image data to be printed may be adopted as the ejection amount information, and the heating setting temperature corresponding to the image data to be printed may be selected. A combination of the image data to be printed and the pass count information may be adopted as the ejection amount information, and the heating setting temperature corresponding to the image data to be printed and the pass count information may be selected.

In the above-described exemplary embodiment, even when the model information of the liquid ejecting device 11 is different, if the models thereof are similar while sharing the same length of the transport path, output of the heater, and the like, the historical information can be shared.

The suction mechanism 30 may be configured so as to be operated to cause the medium 99 to be sucked to the support surface 22A only in a period during which the carriage 27 is scanning to perform the printing to the medium 99, and so as not to cause the negative pressure to act through the suction holes 35 during a transport period of the medium 99.

A humidity adjustment unit, which has at least one of a dehumidification function and a humidification function, may be provided. In this case, a dehumidification drive unit and a humidifying drive unit may be provided separately, or a single drive unit that performs both the dehumidification function and the humidification function may be provided.

The drying information relating to the drying by the drying device 40 may be the air blowing intensity of the air blowing fan 45, and in this case, an air ventilation rate of a space heated by the heater pipe 41 is controlled to adjust the temperature of the medium 99. The drying information relating to the drying by the drying device 40 may be the heating setting temperature of the after-heater 33. The drying information relating to the drying by the drying device 40 may be the heating setting temperature of the platen heater 32. Further, the drying information relating to the drying by the drying device 40 may be any combination of the heating setting temperature of the heater pipe 41, the air blowing intensity of the air blowing fan 45, the heating setting temperature of the after-heater 33, and the heating setting temperature of the platen heater 32. For example, the drying information relating to the drying by the drying device 40 may be a combination of the heating setting temperature of the heater pipe 41 and the air blowing intensity of the air blowing fan 45.

The temperature may be used as the environmental information. For example, when the medium type information is the same, the setting information is set so that a first heating setting temperature applied when the temperature is a first temperature is set to be lower than a second heating setting temperature applied when the temperature is a second temperature, which is lower than the first temperature. Further, the heating setting temperature corresponding to an estimated humidity based on the temperature may be set as the setting information. Further, the relative humidity may be used as the environmental information. Furthermore, the environmental information may be any combination of the temperature, the relative humidity, and the absolute humidity. That is, the environmental information may be at least one of the temperature and the humidity.

A method for the control unit 70 to acquire the medium type information is not limited to acquiring the medium type information from the printing condition information included in the job. The control unit 70 may acquire the medium type information from a detection result of a sensor that detects the medium type information by detecting the front surface of the roll body 101, or may acquire the medium type information by reading, using a reading unit, a one-dimensional code or a two-dimensional code formed at a predetermined position on a portion of the roll body 101 other than the medium 99, such as a core member of the roll body 101.

The setting information is not limited to a table such as the parameter setting table PT. The setting information may be a calculation formula that associates the medium type information, the environmental information, and the ejection amount information with the drying information. The control unit 70 stores the calculation formula for calculating the value of the drying information, as the setting information in the storage unit 80. This calculation formula may be a function having the medium type information, the environmental information, and the ejection amount information as variables, for example.

The humidity detector 53 acquires the absolute humidity AH outside the housing 12 by being disposed in the section of the housing 12, through which the outside air is introduced into the housing 12, but the humidity detector 53 may be installed outside the housing 12.

The drying device 40 need not necessarily be provided with the heater pipe 41, and may have a configuration provided with only an air blowing function for drying the medium 99 using the air blown by the air blowing fan 15. Further, the drying device 40 need not necessarily be provided, and a configuration may be employed in which the drying is performed by the after-heater 33.

The control unit that controls the drying device 40 may be provided separately from the control unit of the liquid ejecting device 11.

The drying device 40 itself may be provided separately from the liquid ejecting device 11.

The liquid ejecting device 11 may transport the medium 99 after the printing, to another device provided with a winding device. Further, the liquid ejecting device 11 need not necessarily be provided with the feeding unit 15, and may be provided with the ejecting unit 28 that ejects the liquid onto the medium 99 fed from the feeding unit 15 provided in another device.

The transport path is not limited to a trapezoidal transport path in a side view, and may be a path in any shape, such as an entirely flat transport path extending horizontally.

The medium 99 is not limited to the sheet, and may be a synthetic resin film or sheet, a cloth, a non-woven fabric, a laminate sheet, or the like. Further, the medium 99 is not limited to the long medium such as a roll of paper, but may be a single sheet paper. Furthermore, the medium 99 is not limited to a medium in which wrinkles are generated when the printing failure occurs, but may be a medium in which curling occurs when the printing failure occurs.

The liquid ejecting device 11 may be a multi-functional machine having a scanner function and a copy function, in addition to the printing function.

Respective functions of the liquid ejecting device 11, the host device 150, and the server device 200 may be provided in any device, or one of the functions may be provided by a plurality of the devices. For example, the liquid ejecting device 11 may control the ejecting unit 28 and the drying device 40, and the host device 150 may acquire the drying information.

In the above-described exemplary embodiment, some or all of the functions of the host device 150 may be installed in the liquid ejecting device 11.

In the above-described exemplary embodiment, the liquid ejecting device 11 and the server device 200 may be directly communicably coupled with each other, instead of communicating via the host device 150. In this case, the host device 150 need not necessarily be provided.

In the above-described exemplary embodiment, a storage medium corresponding to the storage unit 220 of the server device 200 may be directly coupled to the liquid ejecting device 11. In this case, the liquid ejecting system 10 need not necessarily be provided with the host device 150 and the server device 200, and the present disclosure may be applied as the liquid ejecting device 11. Further, a setting table may be stored in advance in the storage unit 80 of the liquid ejecting device 11, and in this case, the storage unit 80 of the liquid ejecting device 11 functions as an example of a storage unit.

Hereinafter, technical concepts and effects thereof that are understood from the above-described exemplary embodiment and modified examples will be described.

A liquid ejecting system includes an environmental information acquiring unit configured to acquire, as environmental information, at least one of a temperature and a humidity, an ejecting unit configured to eject a liquid onto a medium, a drying unit configured to dry the medium onto which the liquid is ejected by the ejecting unit, a control unit configured to control the ejecting unit and the drying unit, and a storage unit configured to store setting information that associates a plurality of parameters including medium type information relating to a type of the medium, the environmental information including at least one of a temperature and a humidity and also including ejection amount information relating to an ejection amount of the liquid per area of the medium, with drying information that is information relating to drying by the drying unit. The control unit acquires, as a liquid ejection condition, the medium type information and the ejection amount information, and performs liquid ejection control that ejects the liquid onto the medium from the ejecting unit, based on the ejection amount information acquired as the liquid ejection condition. The control unit acquires, based on the setting information stored in the storage unit, the drying information corresponding to the medium type information and the ejection amount information acquired as the liquid ejection condition, and the environmental information acquired by the environmental information acquiring unit, and performs drying control that controls the drying unit, based on the acquired drying information.

According to this configuration, even when the environmental information changes, the medium onto which the liquid has been ejected can be dried by the drying unit that is controlled based on the drying information corresponding to the medium type information, the environmental information, and the ejection amount information. Thus, a deterioration in the quality of a product formed as a result of the liquid ejection can be suppressed without changing the ejection amount information in accordance with the environmental information, and the liquid can be ejected onto the medium in accordance with the medium type information, the environmental information, and the ejection amount information.

In the liquid ejecting system described above, the ejecting unit may be configured to move in a scanning direction while ejecting the liquid, and the ejection amount information may be a pass count that indicates the number of scans in which the liquid is ejected by the ejecting unit onto a same region of the medium.

According to this configuration, even when the environmental information changes, the medium onto which the liquid has been ejected can be dried by the drying unit that is controlled based on the drying information corresponding to the medium type information, the environmental information, and the pass count. Thus, the liquid can be ejected onto the medium in accordance with the specified pass count without changing the pass count in accordance with the environmental information.

In the liquid ejecting system described above, the control unit may cause the storage unit to store, as historical information, the medium type information and the ejection amount information acquired as the liquid ejection condition, the environmental information acquired by the environmental information acquiring unit, and the drying information by which the drying control is performed.

According to this configuration, the medium type information, the environmental information, the ejection amount information, and the drying information at a time when the liquid has been ejected onto the medium can be analyzed on the basis of the historical information stored in the storage unit.

In the liquid ejecting system described above, the liquid ejecting system may further include a liquid ejecting device, and a server device configured to communicate with the liquid ejecting device via a network. The liquid ejecting device may include the ejecting unit, the environmental information acquiring unit, the drying unit, and the control unit, and the server device may include a server control unit and the storage unit. The control unit may moreover transmit, as the historical information, model information relating to a model of the liquid ejecting device to the server device, and the server control unit may cause the storage unit to store the historical information from the liquid ejecting device.

According to this configuration, the model information of the liquid ejecting device is additionally transmitted from the liquid ejecting device to the server device as the historical information, and the historical information is stored in the storage unit of the server device. Thus, the historical information can be stored in the storage unit of the server device in a consolidated manner, so that the model information of the liquid ejecting device can be identified.

In the liquid ejecting system described above, the liquid ejecting system may further include a liquid ejecting device, and a server device configured to communicate with the liquid ejecting device via a network. The liquid ejecting device may include the ejecting unit, the environmental information acquiring unit, the drying unit, the control unit and a liquid ejecting device storage unit, and the server device may include a server control unit and the storage unit. The storage unit may store, as the setting information, a setting table that associates model information relating to a model of the liquid ejecting device, the medium type information, the environmental information, and the ejection amount information, with the drying information, and the server control unit may transmit the setting table corresponding to the model information to the liquid ejecting device. The control unit may cause the liquid ejecting device storage unit to store the setting table transmitted from the server device, acquire the drying information corresponding to the medium type information, the environmental information, and the ejection amount information based on the setting table stored in the liquid ejecting device storage unit, and control the drying unit based on the acquired drying information.

According to this configuration, the storage unit of the server device stores, as the setting information, the setting table that associates the model information of the liquid ejecting device, the medium type information, the environmental information, and the ejection amount information, with the drying information, and the setting table is transmitted to the liquid ejecting device. Thus, the setting table stored in the server device can be shared with the liquid ejecting device.

In the liquid dispensing system described above, the liquid ejecting device may further include a liquid ejecting device storage unit. The storage unit may store, as the setting information, a setting table that associates model information relating to a model of the liquid ejecting device, the medium type information, the environmental information, and the ejection amount information, with the drying information, and the server control unit may transmit the setting table corresponding to the model information to the liquid ejecting device. The control unit may cause the liquid ejecting device storage unit to store the setting table transmitted from the server device, acquire the drying information corresponding to the medium type information, the environmental information, and the ejection amount information, based on the setting table stored in the liquid ejecting device storage unit, and control the drying unit, based on the acquired drying information.

According to this configuration, the storage unit of the server device stores, as the setting information, the setting table that associates the model information of the liquid ejecting device, the medium type information, the environmental information, and the ejection amount information, with the drying information, and the setting table is transmitted to the liquid ejecting device. Thus, the setting table stored in the server device can be shared with the liquid ejecting device.

In the liquid ejecting system described above, the liquid ejecting system may further include a housing including therein the ejecting unit. The medium may be transported from outside of the housing to inside of the housing, and the environmental information acquiring unit may acquire the environmental information relating to the outside of the housing.

According to this configuration, the medium is disposed outside the housing before the medium is transported from the outside to the inside of the housing, so an accuracy of the drying information can be improved by acquiring the environmental information outside the housing where the medium is disposed.

A control method of a liquid ejecting device includes an environmental information acquiring step for acquiring at least one of a temperature and a humidity, a liquid ejection condition acquiring step for acquiring, as a liquid ejection condition, medium type information relating to a type of the medium, and ejection amount information relating to an ejection amount of the liquid ejected per area of the medium, and a liquid ejection control step for ejecting a liquid onto a medium, based on the ejection amount information acquired as the liquid ejection condition in the liquid ejection condition acquiring step. The control method includes a drying information acquiring step for acquiring drying information corresponding to the medium type information and the ejection amount information acquired as the liquid ejection condition in the liquid ejection condition acquiring step, and the environmental information acquired in the environmental information acquiring step, based on setting information that associates a plurality of parameters including the medium type information relating to the type of the medium, the environmental information including at least one of a temperature and a humidity and including the ejection amount information relating to the ejection amount of the liquid per area of the medium, with drying information relating to drying of the medium onto which the liquid is ejected. The control method includes a drying control step for drying the medium onto which the liquid is ejected, based on the drying information acquired in the drying information acquiring step. According to this method, the same effects as those of the liquid ejecting system described above can be obtained.

What is claimed is:

1. A liquid ejecting system comprising:

an environmental information acquiring unit configured to acquire, as environmental information, an absolute humidity;

an ejecting unit configured to eject a liquid onto a medium;

a drying unit configured to dry the medium onto which the liquid is ejected by the ejecting unit;

a control unit configured to control the ejecting unit and the drying unit; and a storage unit configured to store setting information that associates a plurality of parameters including medium type information relating to a type of the medium, the environmental information including the absolute humidity and also including ejection amount information relating to an ejection amount of the liquid per area of the medium, with drying information that is information relating to drying by the drying unit, wherein the control unit acquires, as a liquid ejection condition, the medium type information and the ejection amount information, performs liquid ejection control that ejects the liquid onto the medium from the ejecting unit, based on the ejection amount information acquired as the liquid ejection condition, acquires, based on the setting information stored in the storage unit, the drying information corresponding to the medium type information and the ejection amount information acquired as the liquid ejection condition, and the environmental information acquired by the environmental information acquiring unit, and performs drying control that controls the drying unit, based on the acquired drying information.

2. The liquid ejecting system according to claim 1, wherein the ejecting unit is configured to move in a scanning direction while ejecting the liquid, and the ejection amount information is a pass count that indicates the number of scans in which the liquid is ejected by the ejecting unit onto a same region of the medium.

3. The liquid ejecting system according to claim 1, wherein the control unit causes the storage unit to store, as historical information, the medium type information and the ejection amount information acquired as the liquid ejection condition, the environmental information acquired by the environmental information acquiring unit, and the drying information by which the drying control is performed.

4. The liquid ejecting system according to claim 3, further comprising:

a liquid ejecting device; and a server device configured to communicate with the liquid ejecting device via a network, wherein the liquid ejecting device includes the ejecting unit, the environmental information acquiring unit, the drying unit, and the control unit, the server device includes a server control unit and the storage unit, the control unit moreover transmits, as the historical information, model information relating a model of the liquid ejecting device to the server device, and the server control unit causes the storage unit to store the historical information from the liquid ejecting device.

5. The liquid ejecting system according to claim 4, wherein the liquid ejecting device further includes a liquid ejecting device storage unit, the storage unit stores, as the setting information, a setting table that associates model information relating to a model of the liquid ejecting device, the medium type information, the environmental information, and the ejection amount information, with the drying information, the server control unit transmits the setting table corresponding to the model information to the liquid ejecting device, and the control unit causes the liquid ejecting device storage unit to store the setting table transmitted from the server device, acquires the drying information corresponding to the medium type information, the environmental information, and the ejection amount information, based on the setting table stored in the liquid ejecting device storage unit, and controls the drying unit, based on the acquired drying information.

6. The liquid ejecting system according to claim 1, further comprising:

a liquid ejecting device; and a server device configured to communicate with the liquid ejecting device via a network, wherein the liquid ejecting device includes the ejecting unit, the environmental information acquiring unit, the drying unit, the control unit, and a liquid ejecting device storage unit, the server device includes a server control unit and the storage unit, the storage unit stores, as the setting information, a setting table that associates model information relating a model of the liquid ejecting device, the medium type information, the environmental information, and the ejection amount information, with the drying information, the server control unit transmits the setting table corresponding to the model information to the liquid ejecting device, and the control unit causes the liquid ejecting device storage unit to store the setting table transmitted from the server device, acquires the drying information corresponding to the medium type information, the environmental information, and the ejection amount information, based on the setting table stored in the liquid ejecting device storage unit, and controls the drying unit, based on the acquired drying information.

7. The liquid ejecting system according to claim 1, further comprising a housing including therein the ejecting unit, wherein the medium is transported from outside of the housing to inside of the housing, and the environmental information acquiring unit acquires the environmental information relating to the outside of the housing.

* * * * *